US010160223B2

(12) United States Patent
Kaneko et al.

(10) Patent No.: US 10,160,223 B2
(45) Date of Patent: Dec. 25, 2018

(54) INK CIRCULATION DEVICE FOR INK JET HEAD

(71) Applicant: TOSHIBA TEC KABUSHIKI KAISHA, Tokyo (JP)

(72) Inventors: Yoshiaki Kaneko, Mishima Shizuoka (JP); Kazuhiro Hara, Numazu Shizuoka (JP); Kazuhiko Ohtsu, Mishima Shizuoka (JP); Taiki Goto, Mishima Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/657,696

(22) Filed: Jul. 24, 2017

(65) Prior Publication Data

US 2018/0056661 A1 Mar. 1, 2018

(30) Foreign Application Priority Data

Aug. 26, 2016 (JP) ..... 2016-166091

(51) Int. Cl.
*B41J 2/175* (2006.01)
*B41J 2/18* (2006.01)
*B41J 2/19* (2006.01)

(52) U.S. Cl.
CPC ..... *B41J 2/17566* (2013.01); *B41J 2/175* (2013.01); *B41J 2/17596* (2013.01); *B41J 2/18* (2013.01); *B41J 2/19* (2013.01)

(58) Field of Classification Search
CPC ..... B41J 2/17566; B41J 2/17596; B41J 2/04531; B41J 2/04535; B41J 2/04571; B41J 2/04563; B41J 2/0454; B41J 2/175; B41J 2/195; B41J 2/04596
See application file for complete search history.

(56) References Cited

U.S. PATENT DOCUMENTS

2011/0242236 A1 10/2011 Uezawa
2014/0292963 A1 10/2014 Hara et al.

*Primary Examiner* — Kristal Feggins
(74) *Attorney, Agent, or Firm* — Patterson & Sheridan, LLP

(57) ABSTRACT

An ink circulation device for an ink jet head includes a first ink storage unit that stores ink to be supplied to an ink jet head, a second ink storage unit that stores ink to be returned from the ink jet head, a pump that operates according to an electric signal to transport the ink from the second ink storage unit to the first ink storage unit, a filter between the pump and the first ink storage unit, a first pressure sensor configured to detect an internal pressure of the first ink storage unit, a second pressure sensor configured to detect an internal pressure between the pump and the filter, and a drive circuit configured to generate the electric signal according to a pressure difference between the internal pressure detected by the second pressure sensor and the internal pressure detected by the first pressure sensor.

20 Claims, 16 Drawing Sheets

$P=(4\gamma\cos\theta)/D$
P: BUBBLE POINT PRESSURE [Pa]
γ: SURFACE TENSION OF INK [N/m]
θ: CONTACT ANGLE OF INK AND FILTER [rad]

| WAVEFORM N | Vp-p (V) |
|---|---|
| 0 (INITIAL WAVEFORM) | 200 (INITIAL VOLTAGE) |
| 1 | 300 |
| 2 | 280 |
| 3 | 260 |
| 4 | 240 |
| 5 | 220 |
| 6 | 200 |
| 7 | 180 |
| 8 | 160 |
| 9 | 140 |
| 10 | 120 |

| WAVEFORM N | DRIVE FREQUENCY (Hz) |
|---|---|
| 0 (INITIAL WAVEFORM) | 100 (INITIAL FREQUENCY) |
| 1 | 200 |
| 2 | 190 |
| 3 | 180 |
| 4 | 170 |
| 5 | 160 |
| 6 | 150 |
| 7 | 140 |
| 8 | 130 |
| 9 | 120 |
| 10 | 100 |

INK CIRCULATION DEVICE FOR INK JET HEAD

CROSS-REFERENCE TO RELATED APPLICATION

This application is based upon and claims the benefit of priority from Japanese Patent Application No. 2016-166091, filed Aug. 26, 2016, the entire contents of which are incorporated herein by reference.

FIELD

Embodiments described herein relate generally to an ink circulation device for a circulation-type ink jet head of an ink jet recording apparatus.

BACKGROUND

An ink jet recording apparatus discharges ink drops on a medium, such as paper, and forms an image and letters using the ink. The ink jet recording apparatus includes an ink jet head which discharges the ink drops according to an image signal.

The ink jet head includes nozzles that discharge ink drops, an ink pressure chamber that communicates with the nozzles, and a pressure generation element that generates pressure which causes ink in the pressure chamber to be discharged from the nozzles. A piezoelectric body is used as the pressure generation element. A piezoelectric element (also referred to as "piezo element" for short) converts a voltage into a force. In a case where the voltage is applied to the piezoelectric element, contraction, expansion, or shear deformation of the piezoelectric element occurs. Pressure is generated in the ink in a pressure chamber as a result of the deformation of the piezoelectric element. A lead zirconate titanate (PZT) is used as a representative piezoelectric element.

An ink circulation-type ink jet head is known. In the ink circulation-type ink jet head, ink stored in an ink tank external to the ink jet head is supplied to the above-described inkjet head, and a part of the ink is discharged from the nozzles. The ink, which is not discharged from the nozzles, is returned to the ink tank. The ink returned to the ink tank is supplied to the ink jet head again. In order to supply the ink, which is returned to the ink tank, to the ink jet head again, a pump is used. There is a case where the pump, which transports the ink, generates bubbles in the ink. If the bubbles included in the ink are supplied to the ink jet head, defective ink discharge may occur.

DETAILED DESCRIPTION

Figure 1:
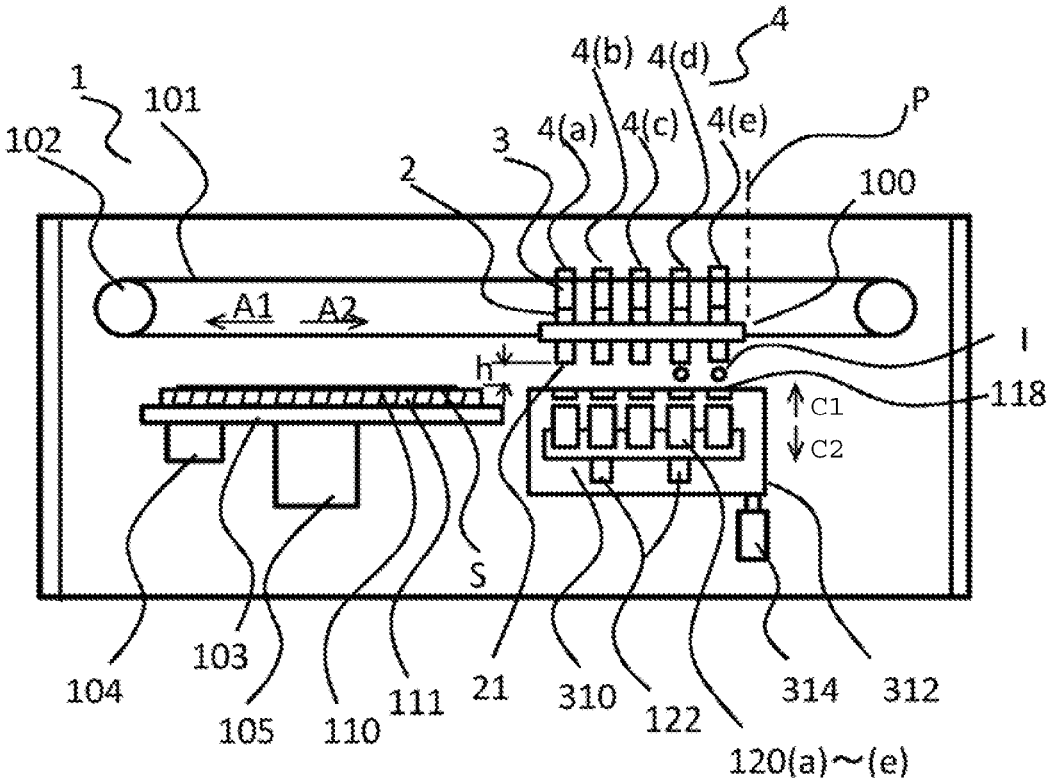
FIG. 1 is a schematic front view of an ink jet recording apparatus according to a first embodiment.

In general, according to one embodiment, there is provided an ink circulation device for an ink jet head including a first ink storage unit that stores ink to be supplied to an ink jet head, a second ink storage unit that stores ink to be returned from the ink jet head, a pump that operates according to an electric signal to transport the ink from the second ink storage unit to the first ink storage unit, a filter between the pump and the first ink storage unit, a first pressure sensor configured to detect an internal pressure of the first ink storage unit, a second pressure sensor configured to detect an internal pressure between the pump and the filter, and a drive circuit configured to generate the electric signal according to a pressure difference between the internal pressure detected by the second pressure sensor and the internal pressure detected by the first pressure sensor.

A recording medium S which will be described below is any one of uncoated paper, coated paper, plain paper, thick paper, an OHP sheet for an overhead projector, and the like.

Ink which will be described below represents liquid that includes a colorant such as a pigment or a dye. Liquid, which does not include the colorant and flows from an ink jet head, is called transparent luster ink. A solvent of the ink is oil based, water based, or an organic solvent. The pigment is scattered in the solvent. The dye is dissolved in the solvent. The pigment includes an organic pigment or an inorganic pigment. The inorganic pigment includes powder acquired by crushing a mineral, black-colored carbon black, white-colored titanium oxide, or ceramic powder. The organic pigment includes cyan, magenta, or yellow-colored powder. The ink includes liquid which hardens when being irradiated with infrared light and ultraviolet light. In addition, a resin or liquid, which has high fluidity in order to form a solid body by repeatedly overlapping ink drops, is also called the ink.

Hereinafter, embodiments of the present disclosure will be described with reference to the accompanying drawings. The same reference numerals indicate the same configurations in the drawings.

First Embodiment

Figure 2:
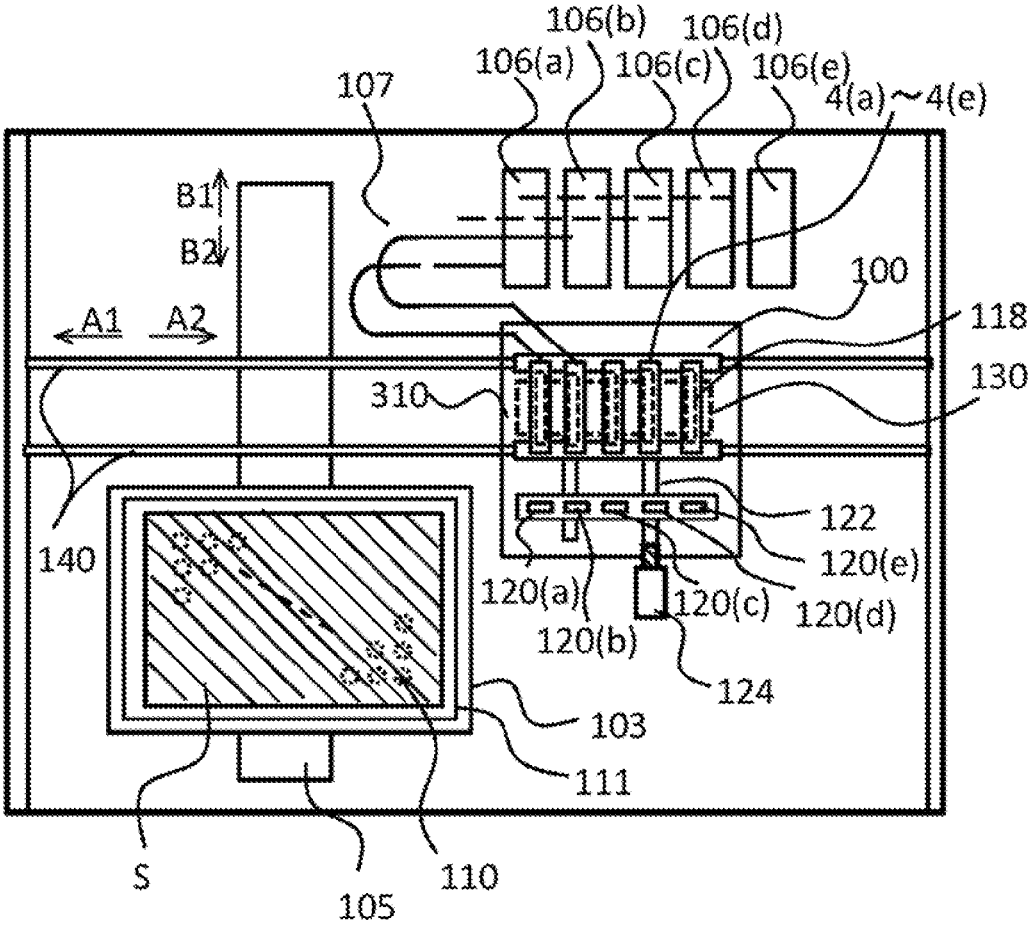
FIG. 2 is a schematic plane view of the inkjet recording apparatus according to the first embodiment.
Figure 3:
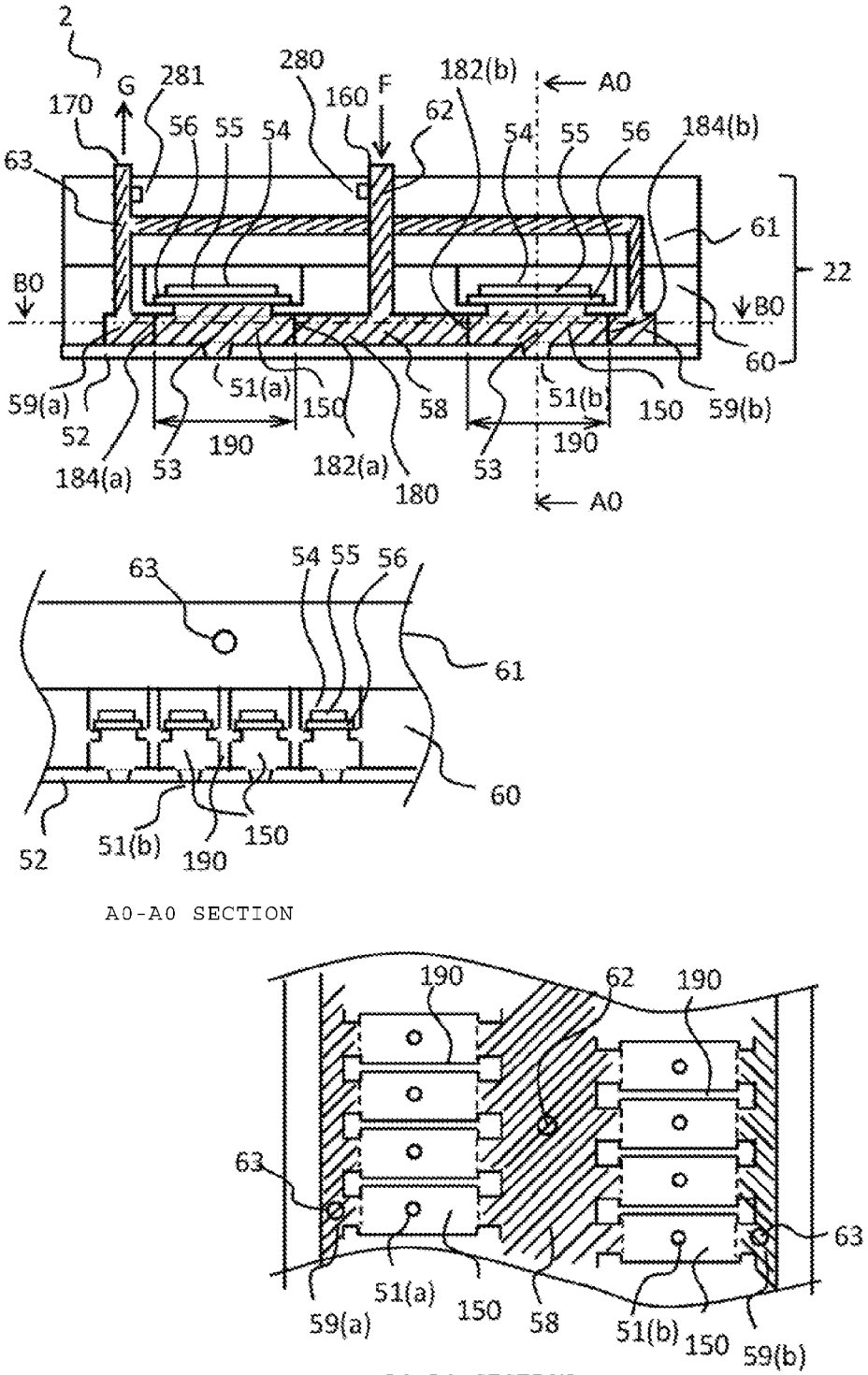
FIG. 3 is a sectional view of a circulation-type ink jet head.

FIG. 1 is a front view illustrating an inkjet recording apparatus 1. FIG. 2 is a plane view illustrating the ink jet recording apparatus 1. FIG. 3 is a view illustrating a configuration of an ink discharge unit of an ink jet head 2.

An ink jet recording unit 4, illustrated in FIG. 1, includes five ink jet recording units 4(*a*) to 4(*e*) which are disposed on a carriage 100. Each of the ink jet recording units 4(*a*) to 4(*e*) includes an ink jet head 2 and an ink circulation device 3. The ink jet recording unit 4(*a*) includes the ink jet head 2, which discharges ink drops I in a direction (downward C2 direction) along a gravity direction, and the ink circulation device 3 on the ink jet head 2. Each of the ink jet recording units 4(*b*) to 4(*e*) has the same configuration as the ink jet recording unit 4(*a*).

The inkjet recording unit 4(*a*) discharges cyan ink, the ink jet recording unit 4(*b*) discharges magenta ink, the ink jet recording unit 4(*c*) discharges yellow ink, and the inkjet recording unit 4(*d*) discharges black ink. The ink jet recording unit 4(*e*) discharges white ink which includes a white-colored pigment.

The carriage 100 is mounted with the ink jet recording units 4(*a*) to 4(*e*) and is fixed to a transport belt 101. The transport belt 101 is connected to a motor 102. In a case where the motor 102 performs normal rotation or reverse rotation, the carriage 100 reciprocates in a direction of an arrow A1 or A2.

A table 103 includes a sheet suction unit 111 and a vacuum pump 104, and is fixed on a slide rail 105 such that the table 103 can move in a B1 or B2 direction (see FIG. 2). The table 103 includes the sheet suction unit 111 that has an upper surface formed with a plurality of small-diameter holes 110. The vacuum pump 104 communicates with an inside of the sheet suction unit 111. The vacuum pump 104 makes the inside of the sheet suction unit 111 to be negative pressure. In a case of being the negative pressure, a recording medium S which is placed on an upper surface of the table 103 is fixed to the sheet suction unit 111. The table 103 reciprocates on the slide rail 105, and transports the recording medium S in the direction of arrow B1 or B2 (see FIG. 2). In a case of printing, a distance h between a surface 21 of the ink jet head 2, which discharges the ink, and the recording medium S is maintained to be 1 mm (FIG. 1).

The ink jet recording apparatus 1 includes a maintenance unit 310. As illustrated in FIG. 1, in a case where the ink jet recording units 4 (*a*) to 4 (*e*) do not form an image, the ink jet recording units 4(*a*) to 4(*e*) move to a position P which is the outside of a movement range of the table 103 and can be moved by the transport belt 101. The maintenance unit 310 is separated from ink discharge surfaces 21 by a distance h (e.g., 1 mm), in the position P of the inkjet recording units 4(*a*) to 4(*e*). The maintenance unit 310 includes caps 118, blades 120, and a waste ink receptacle 130. The maintenance unit 310 is provided in a case 312 which has an open upper part. The case 312 is fixed to a solenoid 314. The solenoid 314 includes a movable core in a coil, and is capable of linearly moving the movable core in a C1 or C2 direction by flowing current through the coil. The case 312 is capable of being moved up and down by the solenoid 314 (direction of an arrow C1 or C2 of FIG. 1). The caps 118 of the maintenance unit 310 are formed to cover the ink discharge surfaces 21 of the respective ink jet recording units 4(*a*) to 4(*e*). The caps 118 prevent the ink from evaporating from the ink discharge surfaces 21, and prevent dust and paper powder from adhering to the ink discharge surfaces 21. In a case where the inkjet recording units 4(*a*) to 4(*e*) form an image, the maintenance unit 310 is moved to a position, which is separated from the ink discharge surfaces 21 by the distance h, by the solenoid 314. After being separated, the inkjet recording units 4(*a*) to 4(*e*) are moved by the transport belt 101, and form an image on the recording medium S. In a case where the ink jet recording units 4 (*a*) to 4 (*e*) do not form an image, the inkjet recording units 4(*a*) to 4(*e*) are moved to the position P. After being moved, the maintenance unit 310 moves upward in the C1 direction by the distance h. In a case where the maintenance unit 310 moves upward, the caps 118 cover the ink discharge surfaces 21.

Rubber blades 120 are installed in the maintenance unit 310. The rubber blades 120(*a*) to 120(*e*) are provided in the respective ink jet recording units 4(*a*) to 4(*e*). The five blades 120 (*a*) to 120 (*e*) reciprocate along a guide rail 122 by a motor 124 (FIG. 2). The blades 120 (*a*) to 120 (*e*) are provided to sweep the ink discharge surfaces 21 in the B1 and B2 directions. In a case where foreign substances, which are adhered to the ink discharge surfaces 21, are removed, the maintenance unit 310 moves upward (C1 direction) by the solenoid 314, and the blades 120(*a*) to 120(*e*) are in contact with the ink discharge surfaces 21. The blades 120 (*a*) to 120 (*e*) wipe the ink discharge surfaces 21, and thus foreign substances, such as ink, dust, and paper power, which are adhered to the ink discharge surfaces 21 are removed. In a case where the blades 120(*a*) to 120(*e*) wipe the ink discharge surfaces 21, the caps are retracted to a place which is not illustrated in the drawing.

The maintenance unit 310 includes the waste ink receptacle 130 (FIG. 2). In a case where a maintenance operation is performed and the ink is forcibly discharged from the nozzles provided in the ink discharge surfaces 21 (the operation known as a spitting operation), it is possible to discard the ink, which is in the vicinity of the nozzles, to the waste ink receptacle 130. The waste ink receptacle 130 stores waste ink which is generated when wiping is performed using the blade 120 and the waste ink which is generated when the spitting operation is performed.

FIG. 2 is a plane view illustrating the ink jet recording apparatus 1.

The carriage 100 mounted with the ink jet recording units 4 (*a*) to 4 (*e*) moves along two rails 140 in the A1 or A2 direction according to the movement of the transport belt 101. The table 103, on which the recording medium S is placed, moves in the B1 or B2 direction. The ink jet recording apparatus 1 is capable of forming an image on an entire surface of the recording medium S by discharging the ink according to an image signal for printing. The ink jet recording apparatus 1 that operates in such a manner is known as a serial-type ink jet recording apparatus.

The ink jet head 2 includes 300 nozzles 51 in the B1 direction. The ink jet recording apparatus 1 forms an image while causing the ink jet recording units 4(*a*) to 4(*e*) to reciprocate in the direction perpendicular to a transport direction (i.e., B1 and B2 directions) of the recording medium S. Therefore, the ink jet recording apparatus 1 forms an image on the recording medium S with a width corresponding to the 300 nozzles 51.

An ink cartridge 106 (*a*) is filled with the cyan ink and communicates with the ink circulation device 3 of the ink jet recording unit 4(*a*) through a tube 107. In the same manner, the ink cartridge 106(*b*) is filled with the magenta ink and communicates with the ink circulation device 3 of the ink jet recording unit 4(*b*). The ink cartridge 106 (*c*) is filled with the yellow ink and communicates with the ink circulation device 3 of the ink jet recording unit 4(*c*). The ink cartridge 106 (*d*) is filled with the black ink and communicates with the ink circulation device 3 of the ink jet recording unit 4(*d*). The ink cartridge 106(*e*) is filled with the white ink and communicates with the ink circulation device 3 of the ink jet recording unit 4(*e*).

A configuration of the ink jet head 2 will be described with reference to FIG. 3. The ink jet head 2 includes an ink supply port 160, an ink discharge unit 22, and an ink outlet port 170. The ink which is supplied from the ink supply port 160 is sent to the ink discharge unit 22. The ink discharge unit 22 discharges a part of the ink as ink drops. Remaining ink is ejected from the ink outlet port 170 to the outside of the ink jet head 2. The ejected ink is returned to the ink supply port 160 again by a circulation device which is provided on the outside of the ink jet head 2. The ink jet head 2 is configured to discharge the ink while circulating the ink.

The ink supply port 160 causes the ink to flow into the ink discharge unit 22. The ink discharge unit 22 includes a substrate 60, which has a nozzle plate 52 and an actuator 54, and a manifold 61. The ink outlet port 170 causes the ink to flow back from the inkjet head 2 to the ink circulation device 3.

The nozzle plate 52 includes a first nozzle row which has 150 nozzles 51(*a*). The first nozzle row is disposed in the B1 direction (FIG. 2). The nozzles 51(*a*) in the first nozzle row are disposed at regular intervals of 169 μm. Furthermore, the nozzle plate 52 includes a second nozzle row which has 150 nozzles 51(*b*). The second nozzle row is also disposed in the B1 direction (FIG. 2). The nozzles 51(*b*) in the second nozzle row are disposed at regular intervals of 169 μm. The first nozzle row and the second nozzle row are offset by 85 μm in the B1 direction. The nozzles 51(*a*) and 51(*b*) are disposed in the B1 direction and are arranged in a direction perpendicular to the movement direction of the carriage 100. The diameter of each of the nozzles 51(*a*) and 51(*b*) is 30 μm. The nozzle plate 52 is formed of a polyimide resin.

The nozzle plate 52 is fixed to the substrate 60. The substrate 60 includes a flow channel 180 therein that allows the ink to pass therethrough. The substrate 60 is formed of alumina. The actuators 54 are provided to face respective nozzles 51(*a*) and 51(*b*) of the nozzle plate 52 across the flow channel 180. The actuator 54 includes a unimorph-type piezoelectric vibration plate in which a piezoelectric ceramic 55 and a vibration plate 56 are stacked. PZT (lead zirconate titanate) is used as a material of the piezoelectric ceramic 55. The piezoelectric ceramic 55 is formed by forming gold electrodes on upper and lower surfaces of the PZT and performing a poling process. Thereafter, the actuator 54 is formed by bonding the piezoelectric ceramic 55 to the silicon nitride vibration plate 56. As illustrated in an A0-A0 cross-section, a boundary wall 190 is provided between adjacent pressure chambers 150. The flow channel 180 which is surrounded by the nozzle plate 52, the actuator 54, and the boundary wall 190, becomes the ink pressure chamber 150. Ends of the boundary wall 190 become ink inflow ports 182(*a*) and 182(*b*) and ink outflow ports 184(*a*) and 184(*b*). 300 ink pressure chambers 150 are provided to correspond to the respective nozzles 51 (*a*) and 51(*b*) of the first nozzle row and the second nozzle row.

The flow channel 180, which is provided between the ink inflow ports 182(*a*) of the 150 ink pressure chambers 150 corresponding to the first nozzle row and the ink inflow ports 182(*b*) of a plurality of ink pressure chambers 150 corresponding to the second nozzle row, becomes a common ink supply chamber 58. The common ink supply chamber 58 supplies the ink to the whole ink pressure chambers 150 through the ink inflow ports 182 (*a*) and 182(*b*). The ink outflow ports 184 (*a*) of the ink pressure chambers 150 in the first nozzle row are connected to a common ink outflow chamber 59(*a*). In the same manner, the ink outflow ports 184 (*b*) of ink pressure chambers 150 in the second nozzle row are connected to a common ink outflow chamber 59(*b*). The common ink supply chamber 58, the common ink outflow chambers 59 (*a*) and 59 (*b*) form a part of the flow channel 180.

The manifold 61 is fixed to the substrate 60, and supplies the ink to the flow channel 180. The manifold 61 is formed of alumina. The manifold 61 includes an ink supply port 160, an ink distribution passage 62, the ink outlet port 170, and an ink return passage 63. The ink supply port 160 causes the ink to flow into in a direction of an arrow F. As illustrated in a B0-B0 cross-section, the ink distribution passage 62 causes the ink supply port 160 to be connected with the common ink supply chamber 58. An upstream temperature sensor 280 in the head is attached to a wall on a side of the ink distribution passage 62. The upstream temperature sensor 280 detects temperature of the ink which is supplied to the ink jet head 2. The ink outlet port 170 ejects the ink in a direction of an arrow G. The ink return passage 63 includes the two common ink outflow chambers 59 (*a*) and 59 (*b*) which are in contact with the ink outlet port 170. A downstream temperature sensor 281 in the head is attached to a wall on a side of the ink return passage 63. The downstream temperature sensor 281 detects temperature of the ink which is ejected from the ink jet head 2.

The ink moves within the ink jet head 2 in order of the ink supply port 160, the ink distribution passage 62, the common ink supply chamber 58, the ink pressure chamber 150, the common ink outflow chambers (59 (*a*) and 59 (*b*)), the ink return passage 63, and the ink outlet port 170. In the circulation of the ink, some ink is discharged from the nozzles 51 according to the image signal. The remaining ink moves and flows back from the ink outlet port 170 to the ink circulation device 3.

Figure 4A:
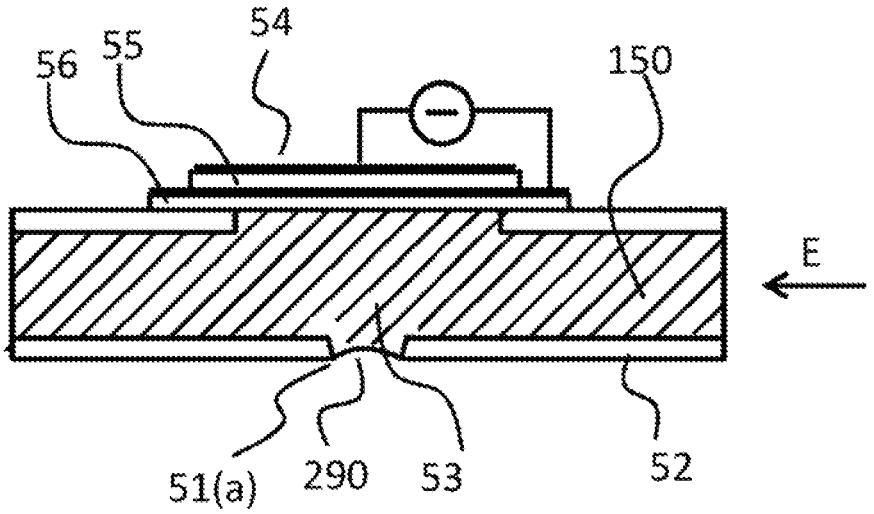
FIGS. 4A and 4B are sectional views illustrating a flow of ink in the circulation-type ink jet head.
Figure 4B:
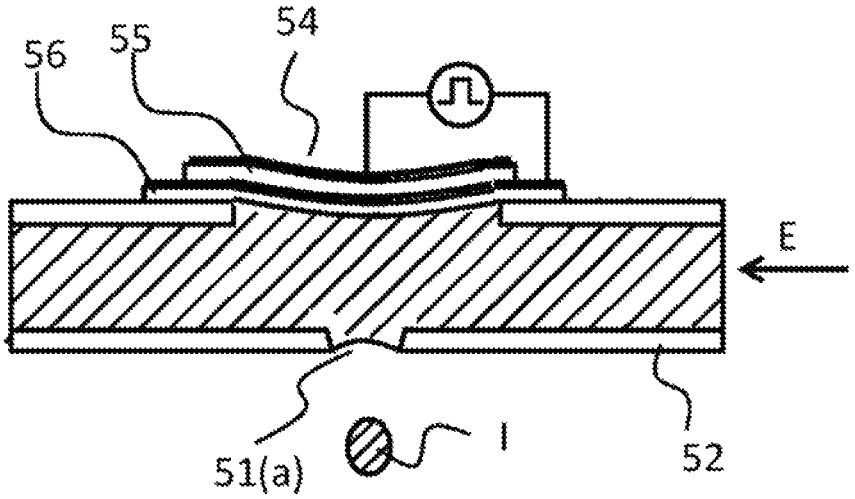

FIGS. 4A and 4B are sectional diagrams illustrating the ink pressure chamber 150 which communicates with a nozzle 51 (*a*) of the ink jet head 2. The ink pressure chamber 150 forms a nozzle branch unit 53 between the nozzle 51 (*a*) and the actuator 54. The ink flows from the common ink supply chamber 58 to the ink pressure chamber 150 and from the ink pressure chamber 150 to the common ink outflow chamber 59 (*a*) in a direction of an arrow E. The nozzle branch unit 53 is a part which branches the ink which is discharged from the nozzles 51 and the ink which returns to the ink return passage 63. In the nozzle 51 (*a*), a meniscus 290, which is an interface between the ink and air, is formed by surface tension of the ink.

FIG. 4A illustrates a state in which an electrical field is not applied to the piezoelectric ceramic 55 and the actuator 54 is not deformed. FIG. 4B illustrates a state in which the electric field is applied to the piezoelectric ceramic 55 and the actuator 54 is deformed. The ink drops I are discharged from the nozzles 51. In a case where the electrical field is applied to the piezoelectric ceramic 55 and the actuator 54 is deformed, a volume of the ink pressure chamber 150 is changed. According to the change in the volume of the ink pressure chamber 150, the ink in the nozzle branch unit 53 becomes ink drops I and is discharged from the nozzle 51(*a*).

Figure 5:
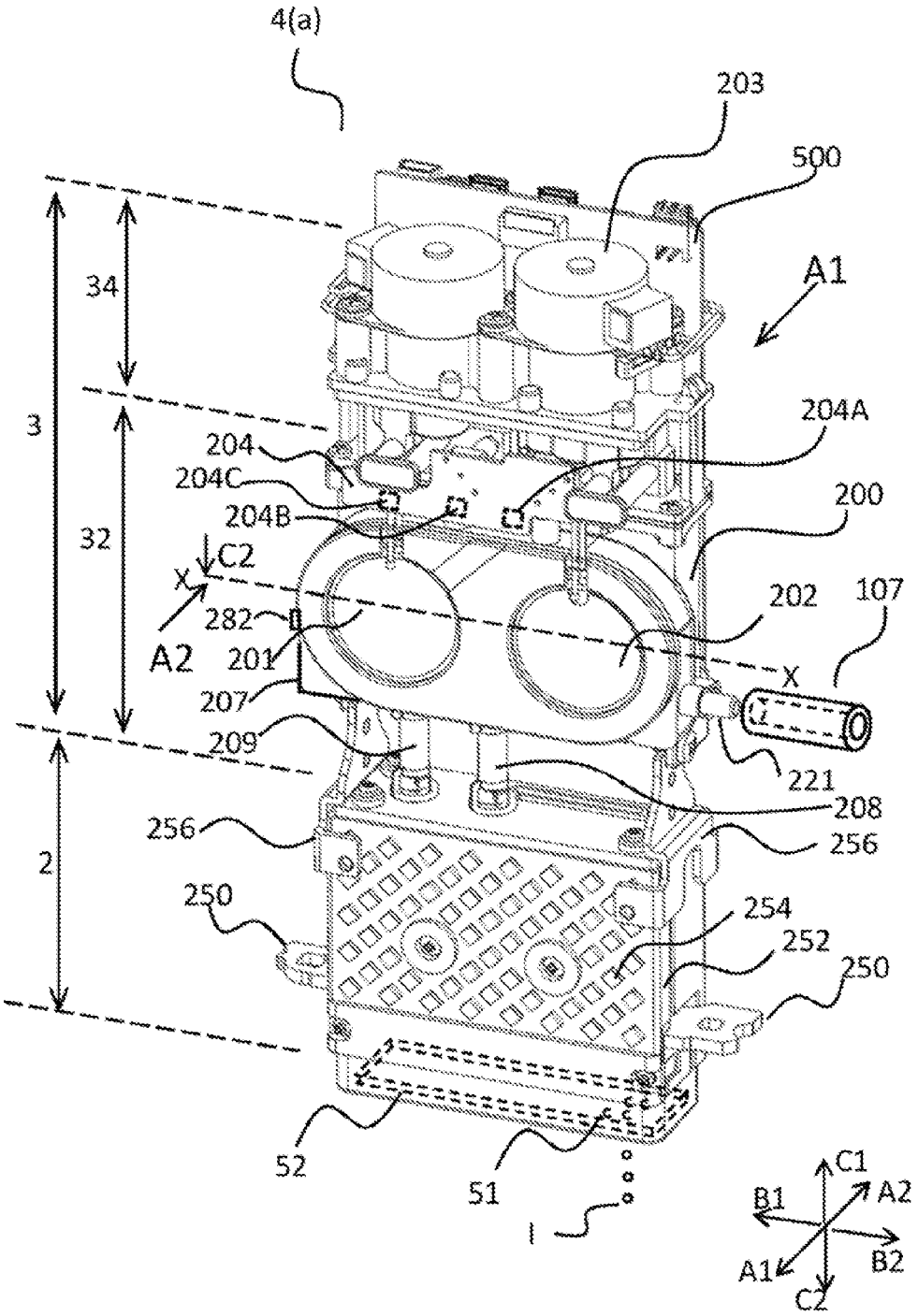
FIG. 5 is a perspective view of the ink jet head mounted with an ink circulation device according to the first embodiment.
Figure 6A:
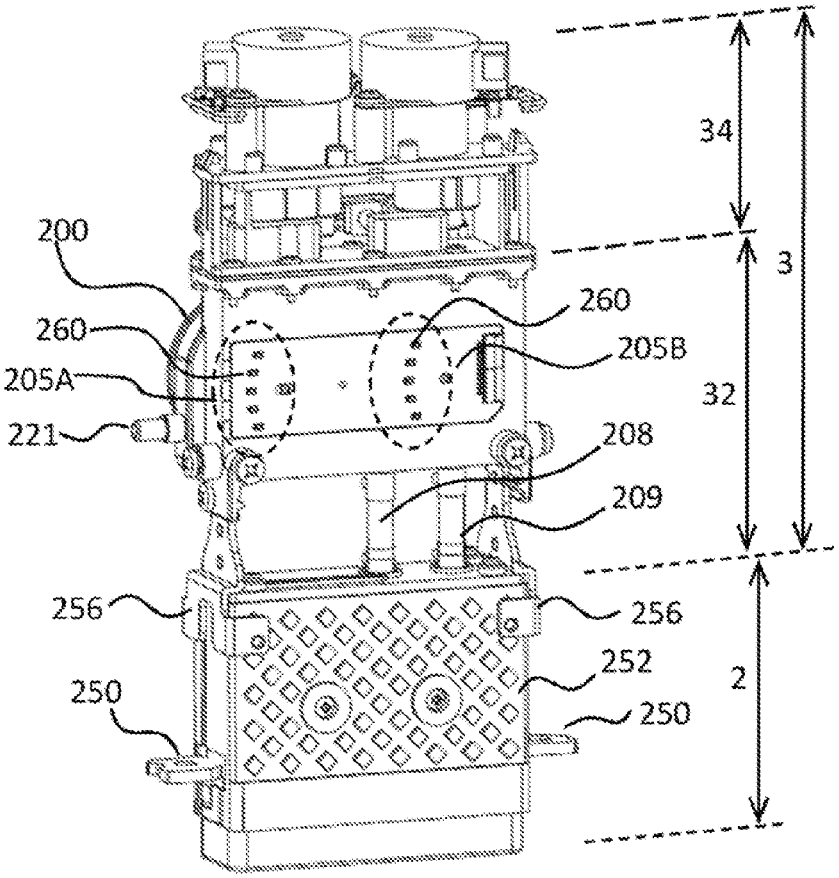
FIG. 6A is a perspective view of the ink jet head illustrated in FIG. 5 when viewed from another plane, and FIG. 6B schematically illustrates a configuration of an ink quantity sensor.

The ink circulation device 3 will be described. FIG. 5 is an external view illustrating the inkjet recording unit 4 (*a*)

mounted with the ink circulation device 3. As described above, the ink jet recording units 4 (*b*) to 4 (*e*) have the same configuration as the ink jet recording unit 4(*a*). FIG. 6A is an external view illustrating the inkjet recording unit 4(*a*) illustrated in FIG. 5 when viewed from an A1 direction.

The ink circulation device 3 is fixed to a housing 252 of the ink jet head 2 by a fastening plate 256. The housing 252 houses the ink jet head 2 illustrated in FIG. 3 and a drive circuit which drives the ink jet head 2. The ink jet head 2 is provided at a lower part of the housing 252, and discharges the ink drops I from the nozzles 51 of the nozzle plate 52 downward (C2 direction). The housing 252 is formed of aluminum. A plurality of protrusions 254 are formed on a surface of the housing 252. The protrusions 254 have heat radiation effect which cools the drive circuit that generates heat in the housing 252. The inkjet head 2 includes metal fittings 250. The ink jet head 2 is fixed to the carriage 100 by the metal fittings 250 (see FIG. 2).

The ink circulation device 3 includes an ink supply/collection unit 32, a pressure adjustment unit 34, and a control circuit 500. The ink supply/collection unit 32 collects the ink from the ink jet head 2, and supplies the ink to the inkjet head 2. The pressure adjustment unit 34 adjusts pressure of air in the ink supply/collection unit 32. A drive circuit 540 controls operations of the ink supply/collection unit 32 and the pressure adjustment unit 34.

The ink supply/collection unit 32 includes an ink casing 200, an ink supply pipe 208, an ink return pipe 209, and a pressure sensor 204. The pressure sensor 204 includes three sensors, that is, a first pressure sensor 204A (supply-side), a second pressure sensor 204B, and a third pressure sensor 204C (collection-side) on one substrate. Each of the pressure sensors (204A, 204B, and 204C) includes, in one embodiment, a semiconductor strain gauge. The substrate mounted with the pressure sensors (204A, 204B, and 204C) is provided above the ink casing 200 in a gravity direction. Each of the pressure sensors (204A, 204B, and 204C) measures internal pressure of the ink casing 200. In the embodiment, the pressure sensors (204A, 204B, and 204C) measure pressure of air in the ink casing 200. As will be described later, the ink casing 200 is not full of the ink. The ink supply pipe 208 communicates with the ink supply port 160 (FIG. 3) of the ink jet head 2. The ink supply pipe 208 supplies the ink to the ink jet head 2 through the ink supply port 160. The ink return pipe 209 communicates with the ink outlet port 170 of the ink jet head 2. The ink which returns from the nozzle branch unit 53 in the ink jet head 2 is collected in the ink casing 200 through the ink return passage 63, the ink outlet port 170, and the ink return pipe 209.

Figure 6B:
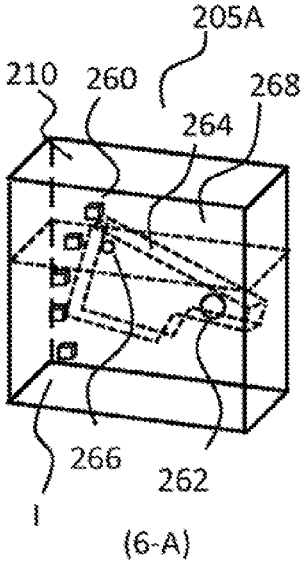
Figure 7A:
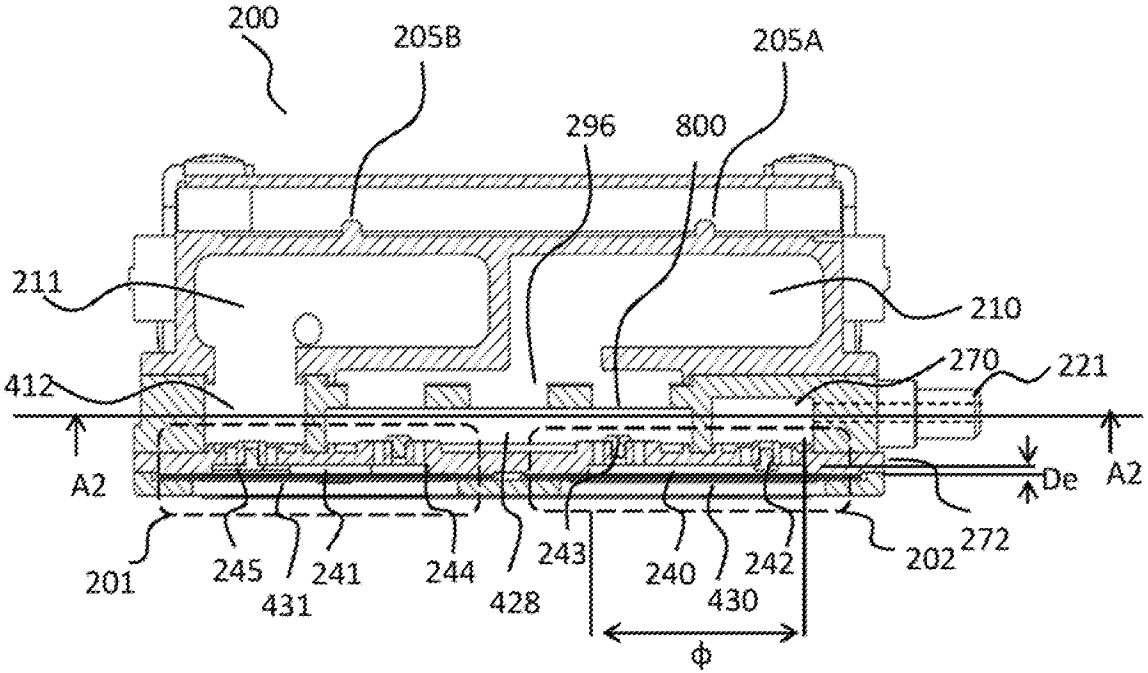
FIG. 7A is a sectional view illustrating the ink circulation device according to the first embodiment.

The ink casing 200 includes an ink replenishment port 221, an ink supply pump 202, an ink circulation pump 201, which are illustrated in FIG. 5, and ink quantity sensors 205A and 205B which are illustrated in FIG. 6A. An internal configuration of the ink casing 200 is illustrated in FIG. 7A (view illustrating a section taken along a line X-X of FIG. 5 when viewed from the C2 direction). Inside the ink casing 200, a float 264 of the ink quantity sensor (FIG. 6B), a first ink introduction tank 270, a supply-side ink tank 210, a collection-side ink tank 211, and a second ink introduction tank 412 are included. Furthermore, in the ink casing 200, a filter 800, an ink chamber 428 between the ink circulation pump 201 and the filter 800, and an ink passage 296 between the filter 800 and the supply-side ink tank 210 are included. The first ink introduction tank 270 becomes a front chamber that guides the ink, which flows into from the ink replenishment port 221, to the ink supply pump 202. The second ink introduction tank 412 communicates with the collection-side ink tank 211 and the ink circulation pump 201.

Referring back to FIG. 5, the ink replenishment port 221 is an opening which is used to supply the ink to the ink casing 200. The ink replenishment port 221 communicates with the ink cartridge 106(*a*) through the tube 107. The ink supply pump 202 and the ink circulation pump 201 are piezoelectric pumps which have the same configuration. A detailed structure of the piezoelectric pump will be described later. The ink supply pump 202 supplies the ink from the ink cartridge 106 (*a*) to the ink casing 200 through the ink replenishment port 221. The ink supply pump 202 supplies the ink corresponding to a quantity, which is consumed for printing and maintenance operations and the like, to the ink casing 200. The ink circulation pump 201 returns the ink from the ink return pipe 209 to the collection-side ink tank 211, and supplies the ink from the collection-side ink tank 211 to the supply-side ink tank 210.

An ink heater 207 is provided on an outside wall of the collection-side ink tank 211 and the supply-side ink tank 210. A heater temperature sensor 282, which is used to detect a heating temperature of the heater 207, is provided on the outside wall of the collection-side ink tank 211 in the vicinity of the ink heater 207. The temperature of the ink is controlled such that the temperature of the ink becomes prescribed temperature according to an ink viscosity.

The ink quantity sensors 205A and 205B will be described with reference to FIGS. 6A and 6B. The ink quantity sensor 205A measures an ink quantity in the supply-side ink tank 210. FIG. 6B schematically illustrates a configuration of the ink quantity sensor 205A. The ink quantity sensor 205A includes five hole sensors 260 that are provided on an outer surface of the supply-side ink tank 210, and a float 264 in the supply-side ink tank 210. The five hole sensors 260 are arranged in an arc shape. The float 264 includes an air layer, a magnetic body 266, and a rotation axis 262 inside. The magnetic body 266 is provided at an end of the float 264 and rotates around the rotation axis 262. The float 264 floats on an ink liquid surface due to buoyancy of the ink in the supply-side ink tank 210. According to the quantity of the ink of the supply-side ink tank 210, a position of the float 264 changes and a position of the magnetic body 266 changes. The position of the magnetic body 266 is detected by the five hole sensors 260 and the quantity of the ink is measured. A part above the ink liquid surface in the supply-side ink tank 210 serves as an air chamber 268. An ink quantity sensor 205B measures the quantity of the ink of the collection-side ink tank 211. A configuration of the ink quantity sensor 205B is the same as the configuration of the ink quantity sensor 205A. Apart above the ink liquid surface in the collection-side ink tank 211 also serves as the air chamber 268.

Figure 7B:
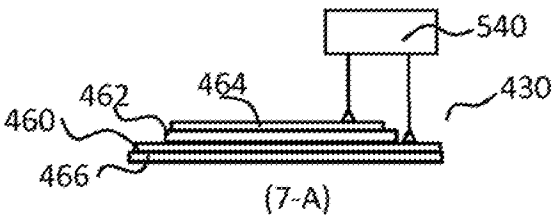
FIG. 7B illustrates a configuration of a piezoelectric actuator.

The ink supply pump 202 and the ink circulation pump 201 will be described with reference to FIGS. 7A and 7B. The ink supply pump 202 includes a substrate 272, a first check valve 242, a pump chamber 240, a piezoelectric actuator 430, and a second check valve 243. The substrate 272 is prepared from a resin mold. The first check valve 242 is provided between the first ink introduction tank 270 and the pump chamber 240 in the substrate 272. According to an operation of the piezoelectric actuator 430, the first check valve 242 transports the ink from the first ink introduction tank 270 to the pump chamber 240 in one direction. The second check valve 243 is provided between the pump chamber 240 and the ink chamber 428 in the substrate 272. According to an operation of the piezoelectric actuator 430, the second check valve 243 transports the ink from the pump chamber 240 to the ink chamber 428 in one direction. A part above the ink liquid surface of the ink chamber 428 serves as the air chamber.

The pump chamber 240 is formed in the substrate 272 and occupies a space Φ having a diameter of 26 mm and a depth De of 0.1 mm. As illustrated in FIG. 7B, the piezoelectric actuator 430 has a structure in which a stainless steel plate 460 having a diameter of 30 mm and a thickness of 0.2 mm, a piezoelectric ceramic 462 (e.g., lead zirconate titanate (PZT)) having a diameter of 25 mm and a thickness of 0.4 mm, and a silver electrode layer 464 are stacked. The silver electrode layer 464 is prepared by coating a silver paste on the piezoelectric ceramic 462 and, thereafter, hardening the silver paste. One surface of the stainless steel plate 460 of the piezoelectric actuator 430 is covered by an insulation resin 466 and the PZT 462 is provided on the other surface. The piezoelectric actuator 430 is disposed such that a surface, which is covered by the resin 466, faces the pump chamber 240, and is fixed to the substrate 272 so as to form a space for the pump chamber 240. The PZT is polarized in a thickness direction.

The stainless steel plate 460 and the silver electrode layer 464 are in contact with the drive circuit 540. The drive circuit 540 applies an alternating current voltage between the stainless steel plate 460 and the silver electrode layer 464. The drive circuit 540 will be described in detail later. In a case where the alternating current voltage is applied in a polarization direction of the PZT 462, the PZT 462 contracts in a direction of a surface which is perpendicular to the thickness. With the contraction of the PZT 462, the piezoelectric actuator 430 expands or contracts a volume of the pump chamber 240. In a case where the volume of the pump chamber 240 expands, an inside of the pump chamber 240 becomes negative pressure. In a case of being the negative pressure, the first check valve 242 causes the ink to flow from the first ink introduction tank 270 into the pump chamber 240, and, at the same time, the second check valve 243 prevents the ink from flowing into the pump chamber 240 from the ink chamber 428. In a case where the volume of the pump chamber 240 contracts, the pump chamber 240 becomes positive pressure. In a case where the pump chamber 240 becomes positive pressure, the first check valve 242 prevents the ink from flowing into the pump chamber 240 from the first ink introduction tank 270, and the second check valve 243 causes the ink to flow into the ink chamber 428 from the pump chamber 240. The PZT 462 repeatedly contracts in accordance with the alternating current voltage. The ink is supplied from the first ink introduction tank 270 to the ink chamber 428 through the repeated contraction.

When an absolute value of the drive voltage is large, the PZT 462 contracts by a large amount. As the absolute value of the drive voltage (which, in one embodiment, is an alternating current voltage) becomes large, the amount of contraction of the PZT 462 becomes larger as well, and thus a liquid feeding amount of the ink supply pump 202 per unit time increases. The absolute value of the drive voltage is driven to be equal to or lower than a voltage (coercive electrical field) which causes polarization reversal of the PZT 462. As a drive frequency of the PZT 462 becomes higher, the number of times that the PZT 462 contracts per unit time increases. Therefore, as the drive frequency becomes higher, the liquid feeding amount per unit time increases. Therefore, it is possible to control the liquid feeding amount of the ink by controlling the absolute value and the frequency of the alternating current voltage.

The ink circulation pump 201 has the same piezoelectric pump configuration as the ink supply pump 202. The ink circulation pump 201 includes a substrate 272, a first check valve 245, a pump chamber 241, a piezoelectric actuator 431, and a second check valve 244. In a case where the substrate 272 of the ink supply pump 202 is formed, the substrate 272 of the ink circulation pump 201 is also integrally formed. The first check valve 245 is provided in the substrate 272 between the second ink introduction tank 412 and the pump chamber 241. The first check valve 245 transports the ink from the second ink introduction tank 412 to the pump chamber 241 in one direction according to an operation of the piezoelectric actuator 431. The second check valve 244 is also provided in the substrate 272 between the pump chamber 241 and the ink chamber 428. The second check valve 244 transports the ink from the pump chamber 241 to the ink chamber 428 in one direction according to an operation of the piezoelectric actuator 431. The ink chamber 428 includes the ink outflow holes from the second check valve 243 of the ink supply pump 202 and the ink outflow holes from the second check valve 244 of the ink circulation pump 201, and sets a boundary with the ink passage 296 through the filter 800. The ink chamber 428 becomes a common liquid chamber of the ink which flows out of the ink supply pump 202 and the ink which flows out of the ink circulation pump 201.

A configuration of the pump chamber 241, a configuration of the piezoelectric actuator 431, and an operation of the ink circulation pump 201 are the same as the configuration and operation of the ink supply pump 202. The ink circulation pump 201 absorbs ink from the collection-side ink tank 211 through the second ink introduction tank 412. The absorbed ink is supplied to the ink chamber 428.

Figure 8:
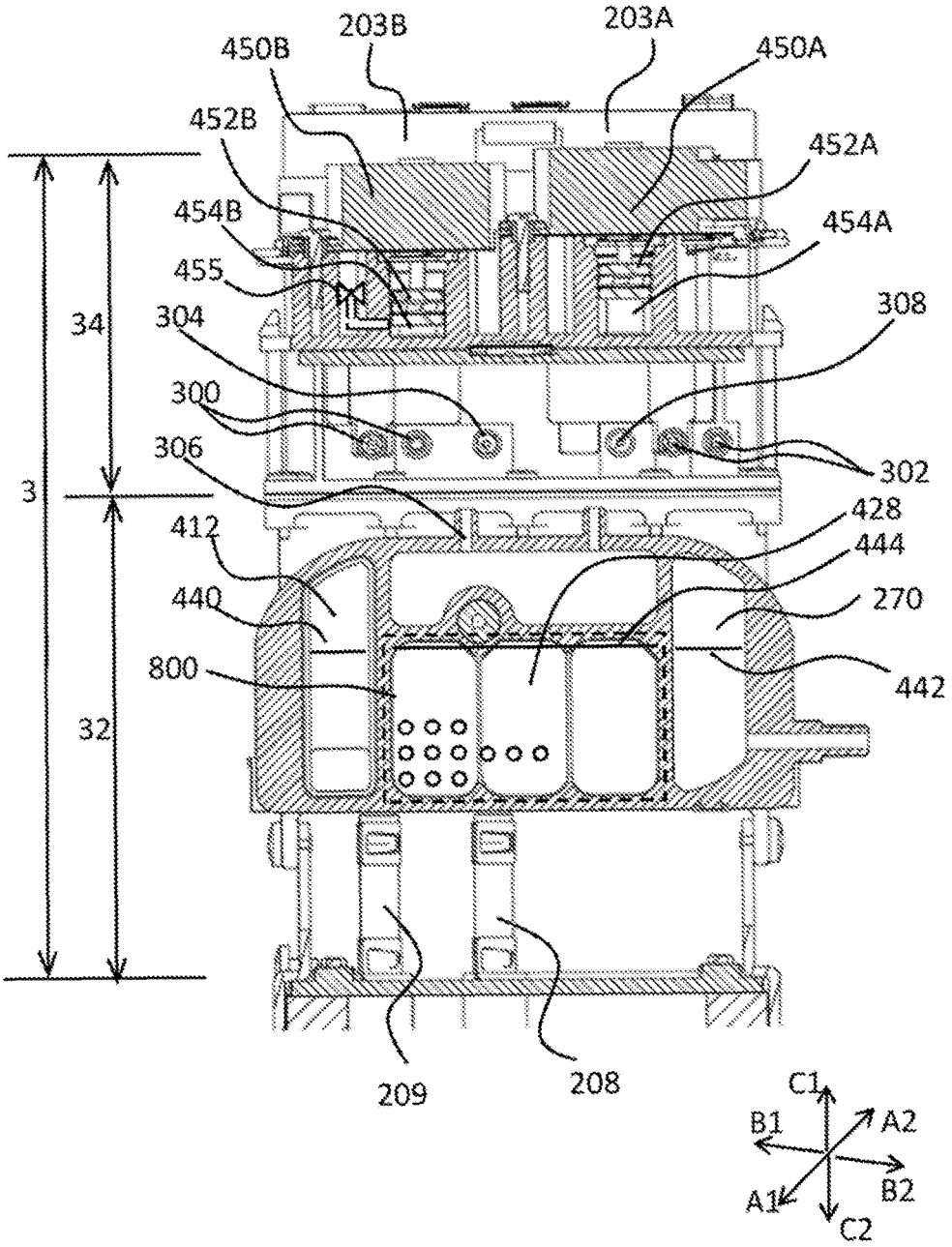
FIG. 8 is a sectional view illustrating the ink circulation device according to the first embodiment when viewed from another plane.

FIG. 8 illustrates a cross-section when viewed from the A2 direction of FIGS. 5 and 7A. As illustrated in FIG. 8, each of the supply-side ink tank 210, the collection-side ink tank 211, and the ink chamber 428 are sealed by the ink and the air chamber above the ink liquid surface. Therefore, in a case where the ink circulation pump 201 absorbs the ink from the second ink introduction tank 412 and sends the ink to the ink chamber 428, the ink is sent from the ink chamber 428 to the supply-side ink tank 210 through the filter 800. The quantity of the ink of the supply-side ink tank 210 increases, and internal pressure of the air chamber of the supply-side ink tank 210 rises. The ink in the supply-side ink tank 210 is pressed by the air in which the pressure has risen, and flows into the ink jet head 2 through the ink supply pipe 208. Here, the quantity of the ink of the collection-side ink tank 211 decreases, and the internal pressure of the air chamber of the collection-side ink tank 211 drops. The ink flows into the collection-side ink tank 211 from the ink jet head 2 through the ink return pipe 209 according to the drop of the internal pressure. The ink in the ink chamber 428 is sent to the supply-side ink tank 210. The filter 800 prevents foreign substances and bubbles in the ink from flowing into the supply-side ink tank 210.

Pressure measurement, which is performed by the pressure sensor 204 (204A, 204B, and 204C) of the ink supply/collection unit 32, and the pressure adjustment unit 34 will be described with reference FIG. 8.

A part above the ink liquid surface 440 of the second ink introduction tank 412 serves as the air chamber. The second ink introduction tank 412 and the collection-side ink tank 211 communicate with each other, and reference numeral 440 indicates the ink liquid surface. The air chamber, which is above the liquid surface of the collection-side ink tank 211, communicates with a third pressure detection opening 304. The third pressure detection opening 304 is linked to the third pressure sensor 204C. A part above an ink liquid surface 444 of the ink chamber 428 serves as the air chamber. The air chamber, which is above the ink liquid surface 444, communicates with a second pressure detection opening 306. The second pressure detection opening 306 is linked to the second pressure sensor 204B. The air chamber, which is above the supply-side ink tank 210, communicates with the first pressure detection opening 308. The first pressure detection opening 308 is linked to the first pressure sensor 204A. Meanwhile, the ink liquid surface 442 indicates an ink liquid surface in the first ink introduction tank 270.

The pressure adjustment unit 34 will be described. The pressure adjustment unit 34 includes a first pressure adjustment device 203A and a second pressure adjustment device 203B. The first pressure adjustment device 203A includes a motor 450A, a piston 452A, and a cylinder 454A. The piston 452A is maintained to slide in the cylinder 454A. The piston 452A moves up and down in the cylinder 454A by the motor 450A. Atmospheric pressure in the cylinder 454A changes according to movement of the piston 452A. The cylinder 454A communicates with the supply-side ink tank 210 through a first pressure adjustment opening 302. Air pressure of the supply-side ink tank 210 is adjusted according to a change in pressure in the cylinder 454A. The second pressure adjustment device 203B includes a motor 450B, a piston 452B, and a cylinder 454B, and has the same configuration as the first pressure adjustment device 203A. The cylinder 454B communicates with the collection-side ink tank 211 through a second pressure adjustment opening 300. The air pressure of the collection-side ink tank 211 is adjusted according to a change in pressure in the cylinder 454B. The second pressure adjustment device 203B further includes an atmospheric air release valve 455. In a case where the ink is replaced, a case where air pressure in the ink tanks 210 and 211 becomes high, or the like, it is possible for the atmospheric air release valve 455 to cause the cylinder 454B to communicate with atmospheric air.

As illustrated in FIG. 5, the nozzles 51 of the ink jet head 2 are open downward. The pressure adjustment unit 34 adjusts pressure of the air chambers at the upper parts of the supply-side ink tank 210 and the collection-side ink tank 211 based on the values of the first pressure sensor 204A and the third pressure sensor 204C. The ink in the nozzles 51 is maintained at −1 KPa through the pressure adjustment, compared to atmospheric pressure. Therefore, in a case where the ink is not discharged from the nozzles, the ink is not leaked from the nozzles 51.

Figure 9A:
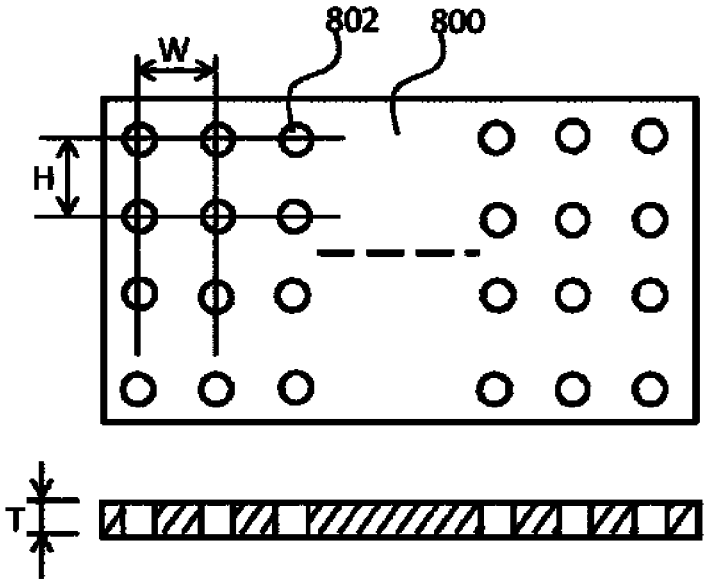
FIG. 9A is a view illustrating a filter according to the first embodiment.

A configuration of the filter 800 will be described with reference to FIG. 9A. A material of the filter 800 is nickel (Ni). A thickness (T) is 10 μm. A filter opening 802 has a circular shape having a diameter of 10 μm. Openings each having a diameter of 10 μm are disposed at a horizontal interval W=40 μm and a vertical interval H=40 μm. The number of openings is 600,000. The filter 800 is formed through nickel electroforming. It is preferable that the thickness of the filter 800 is in a range from 10 to 50 μm. In a case where the thickness is smaller than 10 μm, the filter 800 is deformed due to the ink which is sent out from the ink circulation pump 201. In a case where the filter 800 is deformed, the shape of the opening 802 is changed. In a case where the thickness is larger than 50 μm, the opening 802 also has a length which is equal to or larger than 50 μm. In a case where the length of the opening 802 increases, flow resistance of the opening 802 increases, and thus the quantity of ink which flows through the filter 800 decreases. It is preferable that the thickness of the filter 800 is not deformed by the ink which is sent out from the ink circulation pump 201 and the thickness of the filter 800 is in a range from 10 to 50 μm where it is easy to manufacture.

Figure 10A:
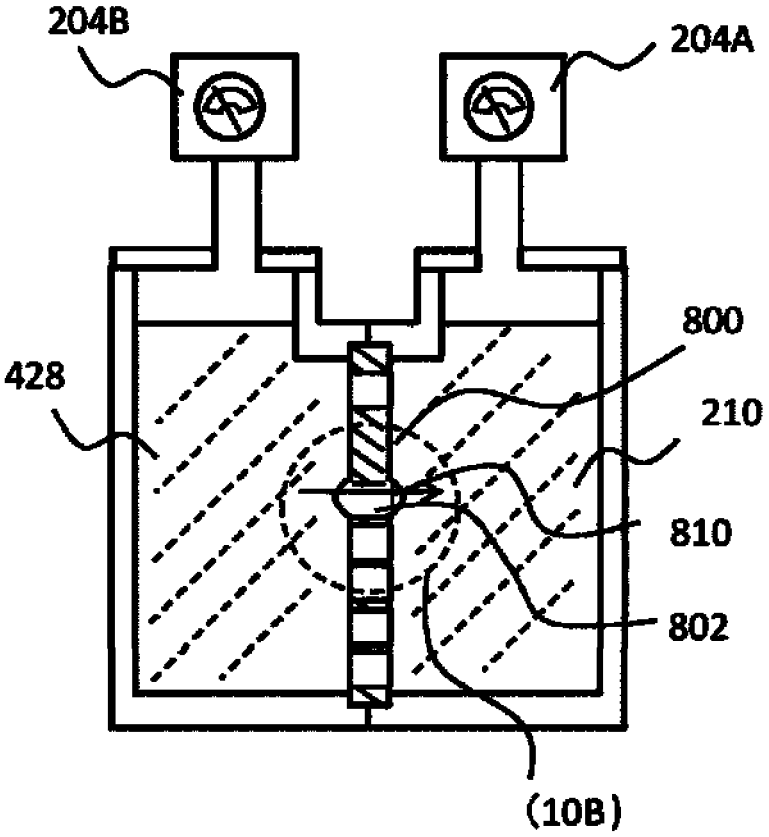
FIG. 10A is a view illustrating the filter according to the first embodiment and bubbles, and FIG. 10B schematically illustrates relationship between bubbles and an opening of the filter.

Bubbles 810 which pass through the filter 800 will be described with reference to FIGS. 10A and 10B. FIG. 10A schematically illustrates the second pressure sensor 204B which communicates with the air chamber at the upper part of the ink chamber 428 and the first pressure sensor 204A which communicates with the air chamber at the upper part of the supply-side ink tank 210. The ink flows into the supply-side ink tank 210 from the ink chamber 428 through the opening 802 of the filter 800. In a case where the bubbles 810 are generated in the ink of the ink chamber 428, there is a possibility that bubbles pass through the opening 802 and flow into the supply-side ink tank 210. In a case where the bubbles 810 flow into the supply-side ink tank 210, there is a possibility that the bubbles 810 enter the ink pressure chamber 150 of the ink jet head 2. In a case where the ink is discharged from the nozzles 51 and bubbles enter the ink pressure chamber 150, pressure which causes the ink to be discharged is reduced. Therefore, there is a possibility that defective discharge occurs. In a case where the ink is not discharged, the bubbles return to the collection-side ink tank in accordance with circulation of the ink even though the bubbles 810 flow into the ink jet head 2.

Figure 10B:
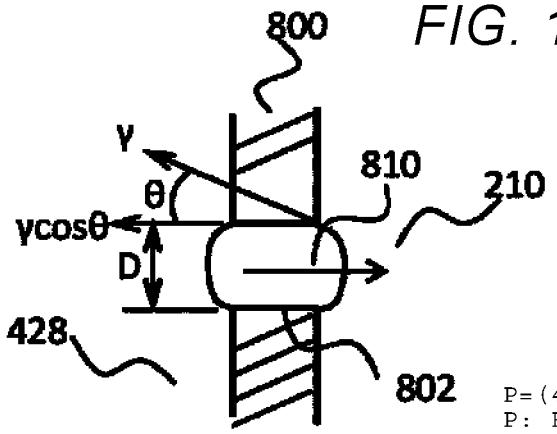

FIG. 10B schematically illustrates relationship between the bubbles 810 and the opening 802 of the filter 800. Pressure of the bubbles acquired in a case where the bubbles 810 pass through the opening 802 is called bubble point pressure (P). The bubble point pressure (P) of the bubbles 810 is expressed using a diameter (D) of the opening 802, surface tension (γ) of the ink, and a contact angle (θ) of the ink and the filter 800.

$$P=(4\gamma \cos \theta)/D$$

P: bubble point pressure [Pa]
γ: surface tension of the ink [N/m]
θ: contact angle [rad] of the ink and the filter
D: diameter [m] of maximum opening The ink, which is sent out by the ink circulation pump 201, is sent out from the ink chamber 428 to the supply-side ink tank 210. In a case where the ink is sent out and a difference between pressure of the air chamber at the upper part of the ink chamber 428 and pressure of the air chamber at the upper part of the supply-side ink tank 210 is equal to or lower than the bubble point pressure, the bubbles 810 stay in the opening 802 due to the surface tension of the ink. That is, it is possible to prevent the bubbles 810 from flowing into the supply-side ink tank 210. The pressure of the air chamber at the upper part of the ink chamber 428 is changed according to the liquid feeding amount of the ink circulation pump 201. Therefore, the liquid feeding amount of the ink circulation pump 201 is changed according to the differential pressure which is acquired from the pressure sensor 204B and the pressure sensor 204A.

Figure 9B:
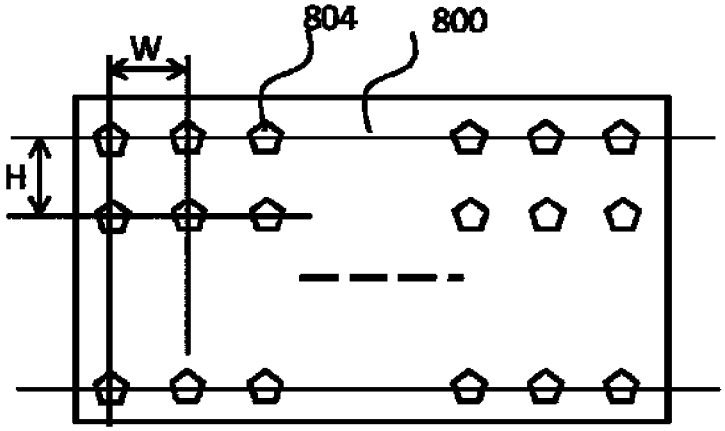
FIGS. 9B and 9C are views illustrating filters according to modifications of the first embodiment.
Figure 9C:
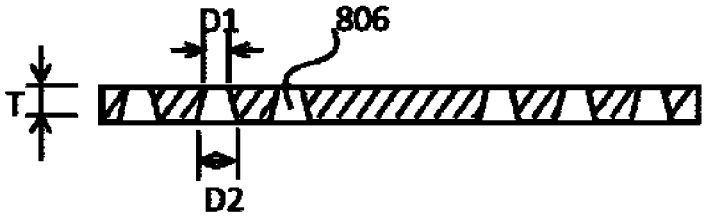

It is possible to cause the opening 802 of the filter 800 to have a shape of polygon 804 as illustrated in FIG. 9B and a shape of a start. In addition, as illustrated in FIG. 9C, it is possible to cause the opening of the filter 800 to have a shape of truncated cone 806. In a case where a diameter D2 of the truncated cone 806 is larger than the diameter D1, D2 is set for the ink chamber 428 and D1 is set for the supply-side ink tank 210. Here, the opening diameter which is used to determine the bubble point pressure is D1. It is possible to use metal or a resin as the material of the filter 800. Furthermore, it is possible for the filter 800 to have a water permeable structure in which fibers are entwined. In a case of the filter 800 in which the fibers are entwined, the bubble point pressure is determined based on an experiment.

Figure 11:
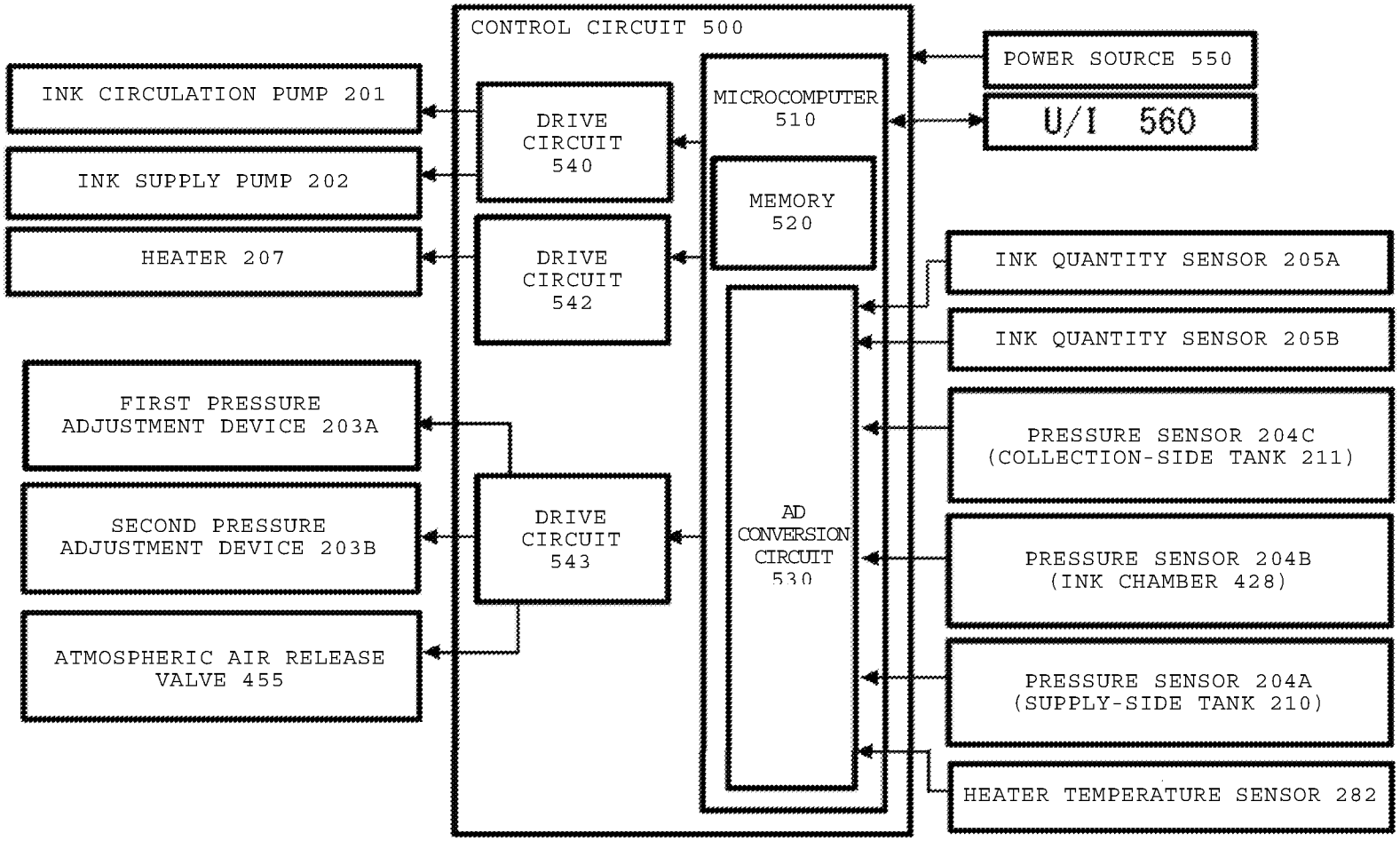
FIG. 11 is a block diagram illustrating a control circuit that controls the ink circulation device.

FIG. 11 illustrates a circuit 500 which controls the ink circulation device 3. The control circuit 500 includes a microcomputer 510, a drive circuit 540, a drive circuit 542, and a drive circuit 543. The control circuit is in contact with an electric source 550 and connected to a user interface (U/I) 560. The microcomputer 510 includes a memory 520 and an AD conversion circuit 530. The AD conversion circuit 530 converts analog output voltages of the ink quantity sensors 205A and 205B, the pressure sensors 204A, 204B, and 204C, and the heater temperature sensor 282 into digital signals. The drive circuit 540 generates the alternating current voltage to be applied to the ink circulation pump 201 and the ink supply pump 202 based on the outputs of the sensors. The drive circuit 540 causes the voltage value and the frequency of the alternating current voltage to vary under the control of the microcomputer 510. The drive circuit 542 generates electric power to drive the heater 207 according to an output of the heater temperature sensor 282. The drive circuit 543 drives the motor 450A of the first pressure adjustment device 203A, the motor 450B of the second pressure adjustment device 203B, and the atmospheric air release valve 455.

Figures 12A, 12B, 12C:
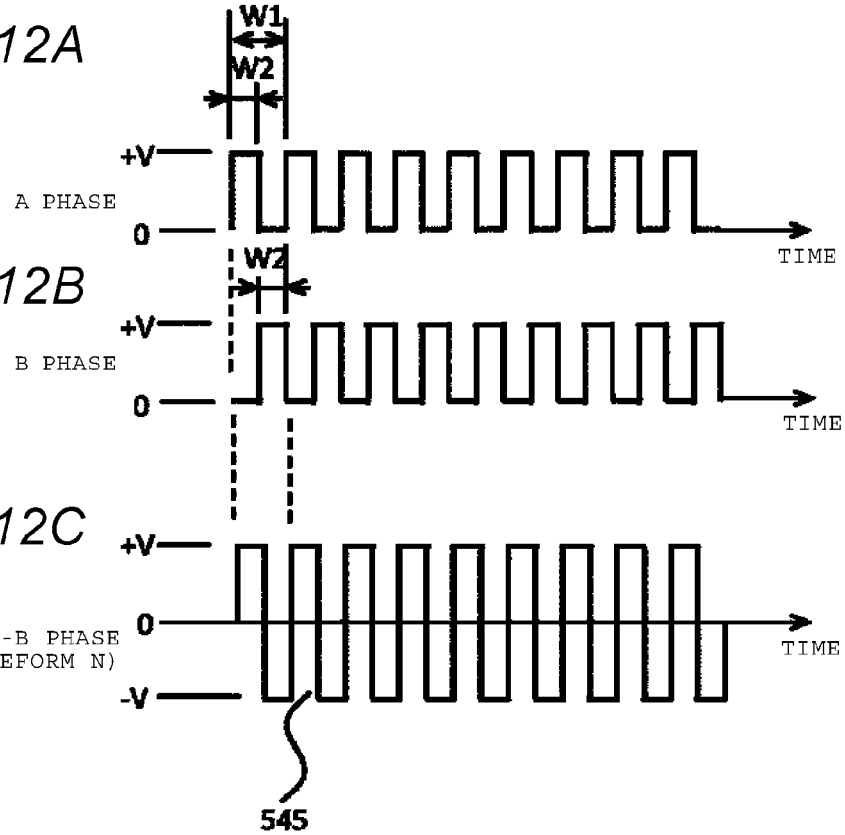
FIGS. 12A to 12C are views illustrating drive waveforms that cause a piezoelectric pump to operate.

FIGS. 12A to 12C illustrate a drive waveform 545 which is generated by the drive circuit 540 to drive the ink circulation pump 201. The drive waveform 545 is generated according to a difference between an A-phase waveform (shown in FIG. 12A) and a B-phase waveform (shown in FIG. 12B). An A-phase waveform has a rectangular wave having a positive unipolar voltage. A highest value of the voltage is +V(V). A rectangular cycle is W1, that is, a frequency is 1/W1. A rectangular pulse width W2 is W1/2. Similarly to the A-phase waveform, a B-phase waveform has a rectangular wave having a positive unipolar voltage. A highest value of the voltage is +V(V). A rectangular cycle is W1, and a frequency is 1/W1. A rectangular pulse width W2 is W1/2. Phases of the A phase and the B phase are offset by 180°. As illustrated in FIGS. 7A and 7B, the piezoelectric actuator 430 of the ink circulation pump 201 includes the stainless steel plate 460, the PZT 462, and the silver electrode layer 464. 0 (V) of A phase is applied to the stainless steel plate 460, and +V(V) is applied to the silver electrode layer 464. 0 (V) of the B phase is applied to the silver electrode layer 464, and +V(V) is applied to the stainless steel plate 460. Since the phases of the A phase and the B phase are offset by 180°, the drive waveform 545, which is applied to the PZT, is acquired as a difference between the A phase and the B phase illustrated in FIG. 12C. The alternating current voltage of a waveform N is generated by changing the value of the voltage and a value of the frequency 1/W1. The ink supply pump is driven in the same manner.

Figure 13:
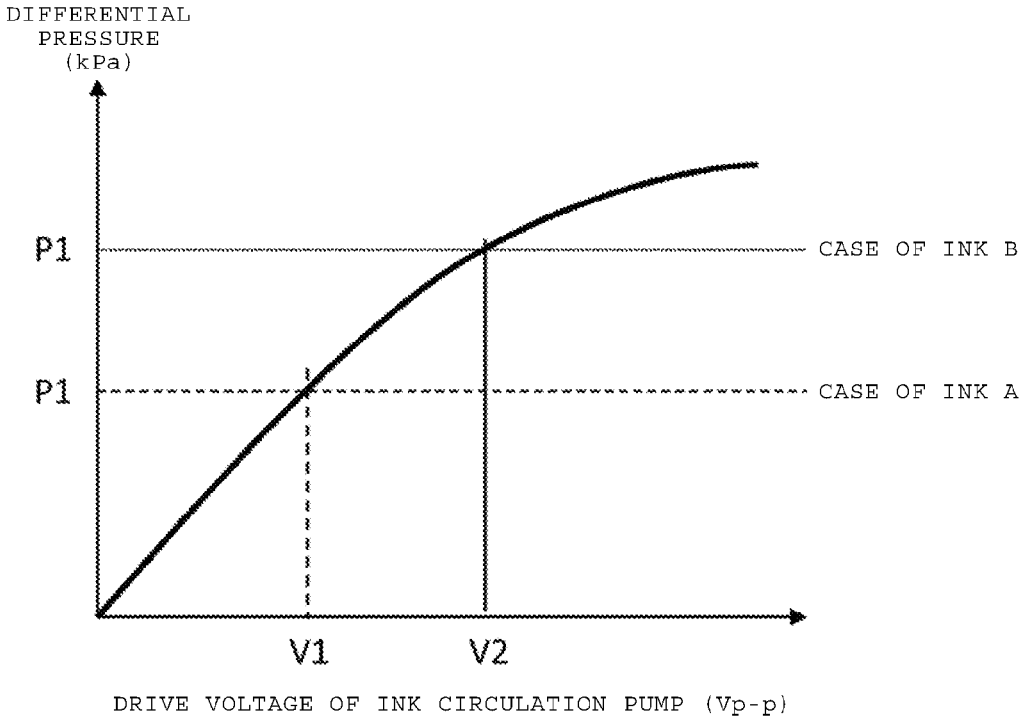
FIG. 13 is a graph illustrating a relationship between a drive voltage and differential pressure, of an ink circulation pump according to the first embodiment.

FIG. 13 illustrates a relationship between the voltage value (Vp-p) of the alternating current voltage, which is applied to the ink circulation pump 201, and the differential pressure (kPa) which is acquired before and after the filter 800. The differential pressure (kPa), which is acquired before and after the filter 800, is a difference between the pressure sensor 204B and the pressure sensor 204A. P1 indicates bubble point pressure of ink A. P2 indicates bubble point pressure of ink B. For example, ink A is oil-based ink which has low surface tension, and ink B is water-based ink which has high surface tension compared to the oil-based ink. In a case of ink A, the drive voltage of the ink circulation pump 201 is operated to be equal to or lower than V1 such that the differential pressure is equal to or lower than P1. In a case of ink B, the drive voltage of the ink circulation pump 201 is operated to be equal to or lower than V2 such that the differential pressure is equal to or lower than P2. As described above, in a case where the drive voltage of the ink circulation pump 201 is controlled such that the differential pressure is equal to or lower than the bubble point pressure, it is possible to prevent the bubbles 810 from passing through the filter 800 and flowing into the ink jet head 2.

As described above, the bubble point pressure is expressed by a function of the diameter (D) of the opening 802 of the filter 800, the surface tension (γ) of the ink, and the contact angle (θ) of the ink and the filter 800. The surface tension (γ) of the ink and the contact angle (θ) are changed according to a type and temperature of the ink. Therefore, the bubble point pressure according to the type and temperature of the ink is acquired in advance and is stored in the memory 520 as a specified value.

The drive voltage of the ink circulation pump 201 is changed in the middle of a waiting state in cases described below as examples.

1) a case where a user of the ink jet recording apparatus 1 initially fills with ink.
2) a case where the ink in the ink tanks (210 and 211) is exhausted, and the ink is filled again.
3) a case where the ink is replaced in order to change a color of the ink or a type of the ink.
4) a case where the ink is heated.
5) a case where the ink is cooled.
6) a case where the user provides an instruction.

Figures 14A, 14B:
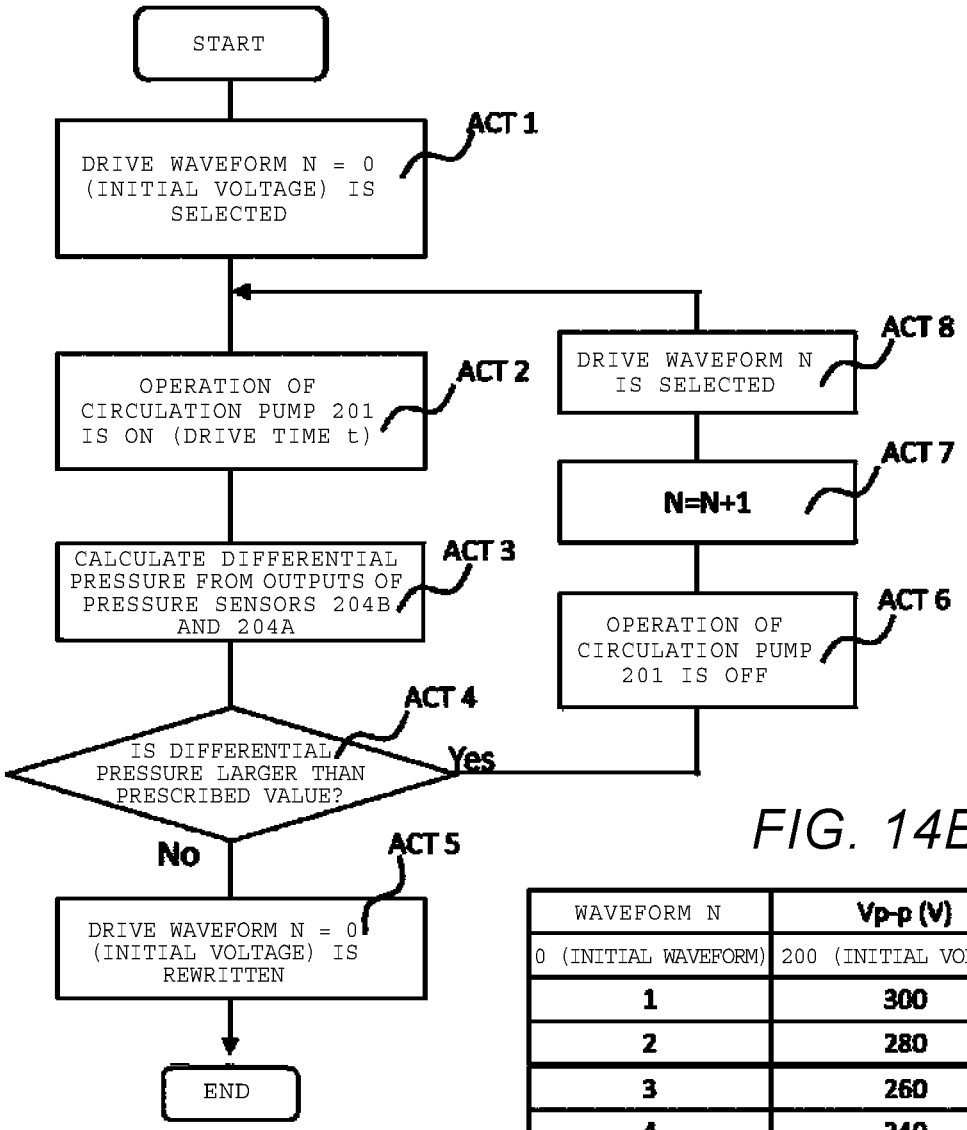
FIG. 14A is a control flowchart according to the first embodiment.
FIG. 14B is a table showing a waveform number and a peak-peak value of a drive voltage.

FIG. 14A is a flowchart illustrating a process of changing the drive voltage of the ink circulation pump 201. FIG. 14B is a table showing a waveform number (N) and a value of the drive voltage (p-p; peak-peak value). The drive voltage of the ink circulation pump 201 is changed such that the differential pressure between the air pressure in the ink chamber 428 and the air pressure of the supply-side ink tank 210 is detected and the differential pressure is equal to or lower than the specified value (e.g., bubble point pressure).

In a case where the change of the drive voltage (Vp-p) starts, the ink circulation pump 201 is operated at an initial value (N=0) voltage 200 Vp-p of the drive waveform (ACT 1). A rectangular wave frequency (1/W1) is 100 Hz. The ink circulation pump 201 is operated at the initial value voltage in t time (ACT 2). The differential pressure between the pressure sensors 204B and 204A is calculated (ACT 3). The differential pressure is compared with the specified value (ACT 4). In a case where the differential pressure is larger than the specified value (YES), the circulation pump 201 stops (ACT 6), and the waveform number is changed (N=N+1) (ACT 7). The voltage of the drive waveform N is changed (ACT 8), and processes in (ACT 2) to (ACT 4) are repeated until the differential pressure is equal to or lower than the specified value. The waveform N of the drive voltage, in which the differential pressure is equal to or lower than the specified value, is set to a new initial value. Thereafter, the ink circulation pump 201 is operated at the drive voltage in which the differential pressure is equal to or lower than the specified value. Subsequently, the ink circulation pump 201 is operated at the new initial value until an instruction to change the drive voltage of the ink circulation pump 201 is generated. As the voltage value becomes larger, the quantity of the ink which is sent out from the ink circulation pump 201 increases. The increase in the quantity of the ink of the ink chamber 428 causes the air pressure to rise. Therefore, the differential pressure becomes large. The drive voltage is sequentially lowered while the waveform N is being changed, and thus control is performed such that the differential pressure is equal to or lower than the specified value. It is preferable that the differential pressure becomes high in order to acquire the quantity of the ink which flows through the filter 800 in a range in which bubbles do not pass through the filter 800.

In a case where the differential pressure is higher than the specified value while the drive voltage is being changed, there is a possibility that bubbles flow into the supply-side ink tank 210 through the filter 800. Bubbles flow into the ink jet head 2 without change. Since the drive voltage is changed in the middle of a waiting state, bubbles have nothing to do with ink discharge from the nozzles 51. Bubbles, which flow into the ink jet head 2, return to the collection-side ink tank 211 through the common ink supply chamber 58, the pressure chamber 150, and the common ink outflow chamber 59. In a case where bubbles are continuously generated, bubbles are gathered in the supply-side ink tank 210 and the collection-side ink tank 211, and thus pressure of the air layer rises. The air pressure of the collection-side ink tank 211 is detected by the pressure sensor 204C. In a case where the air layer increases and a result of detection of the air pressure is higher than the prescribed air pressure, the second pressure adjustment device 203B opens the atmospheric air release valve 455. Extra air, in which bubbles are gathered, is removed by the atmospheric air release valve 455. Thereafter, the second pressure adjustment device 203B adjusts the pressure of the collection-side ink tank 211 and thus the pressure returns to the prescribed pressure value.

In the above description, the pressure of the air layer in the supply-side ink tank 210, the ink chamber 428, and the collection-side ink tank 211 is detected. It is possible to provide a method of detecting the internal pressure except in the air layer. As an example, a piezoelectric body strain gauge is provided in the ink of each of the supply-side ink tank 210, the ink chamber 428, and the collection-side ink tank 211. Pressure, which is generated in the ink, is detected by the strain gauge. A pressure difference of the ink between the ink chamber 428 and the supply-side ink tank 210 is acquired. An electric signal, which drives the piezoelectric pump, is controlled according to the pressure difference.

The ink jet head 2 mounted with the ink circulation device according to the first embodiment can discharge the above-described resin or liquid which has high fluidity. Here, the inkjet recording apparatus functions as a liquid droplet ejection apparatus which includes the ink jet head 2 and the ink circulation device 3.

In the first embodiment, it is possible to prevent bubbles from flowing into the supply-side ink tank 210 even though bubbles are generated in the ink while the ink circulation pump 201 is sending out the ink. Even though bubbles are generated in the ink while the ink supply pump 202 is sending out the ink, it is possible to prevent bubbles from flowing into the supply-side ink tank 210.

In a case where the ink, which is sent out from the ink circulation pump 201, and the ink, which is sent out from the ink supply pump 202, are supplied to the common ink chamber 428, it is possible to reduce a size of the ink circulation device. With the common ink chamber 428, it is possible to prevent bubbles, which are generated in the ink circulation pump 201 or the ink supply pump 202, from flowing into the supply-side ink tank 210 under the control of the ink circulation pump 201.

The first and second pressure sensors 204A and 204B are provided above the ink liquid surface in the gravity direction. Therefore, it is possible for the pressure sensor to stably output a result of measurement without being in contact with the ink.

In a case where a value (drive waveform) of an alternating current voltage which causes the piezoelectric pump to operate is changed, the liquid feeding amount of the ink circulation pump 201 is controlled. It is possible to change the alternating current voltage with a simple circuit configuration.

Second Embodiment

In a second embodiment, other than the configuration of the drive circuit 540 of the ink circulation pump, the configurations of the ink jet recording unit 4 and the ink jet recording apparatus 1 are the same as in the first embodiment.

Figure 15:
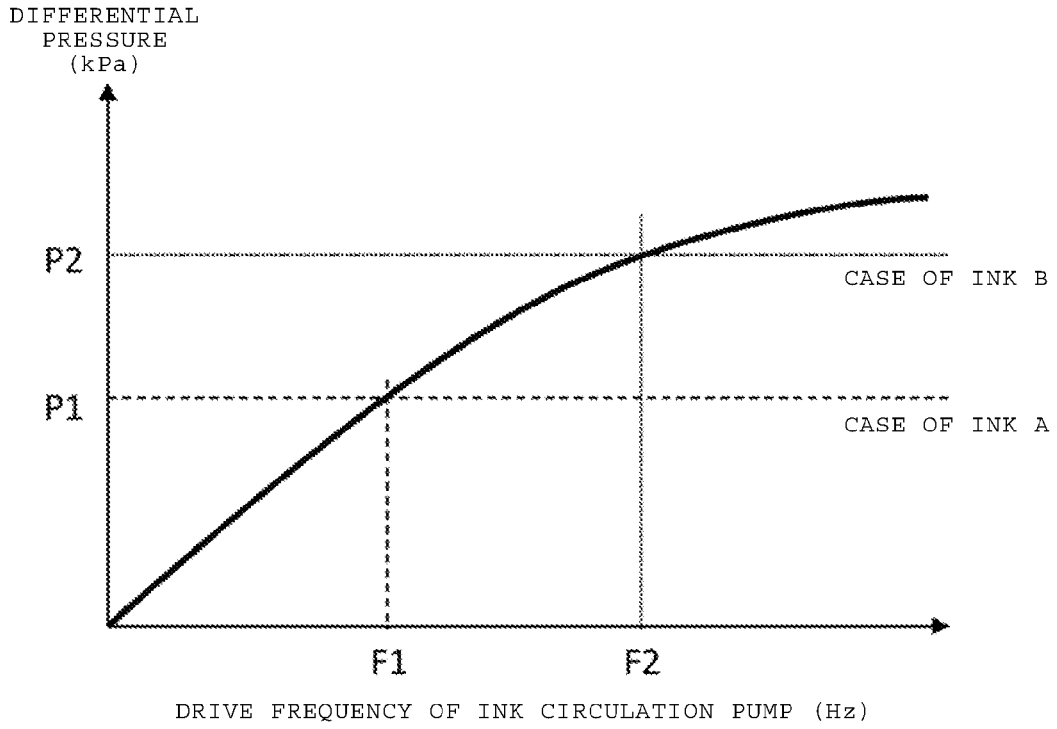
FIG. 15 is a graph illustrating a relationship between a drive frequency and differential pressure of an ink circulation pump according to a second embodiment.

FIG. 15 illustrates a relationship between the drive frequency (rectangular wave illustrated in FIGS. 12A to 12C), which is applied to the ink circulation pump 201, and the differential pressure (kPa) which is acquired before and after the filter 800. The differential pressure which is acquired before and after the filter 800 indicates a difference between the pressure sensor 204B and the pressure sensor 204A. P1 indicates the bubble point pressure of ink A. P2 indicates the bubble point pressure of ink B. In a case of ink A, the ink circulation pump 201 is operated at a drive frequency which is equal to or lower than F1 such that the differential pressure is equal to or lower than P1. In a case of ink B, the ink circulation pump 201 is operated at a drive frequency which is equal to or lower than F2 such that the differential pressure is equal to or lower than P2. As described above, in a case where the drive frequency of the ink circulation pump 201 is controlled such that the differential pressure is equal to or lower than the bubble point pressure, it is possible to prevent the bubbles 810 from passing through the filter 800 and flowing into the ink jet head 2.

Figures 16A, 16B:
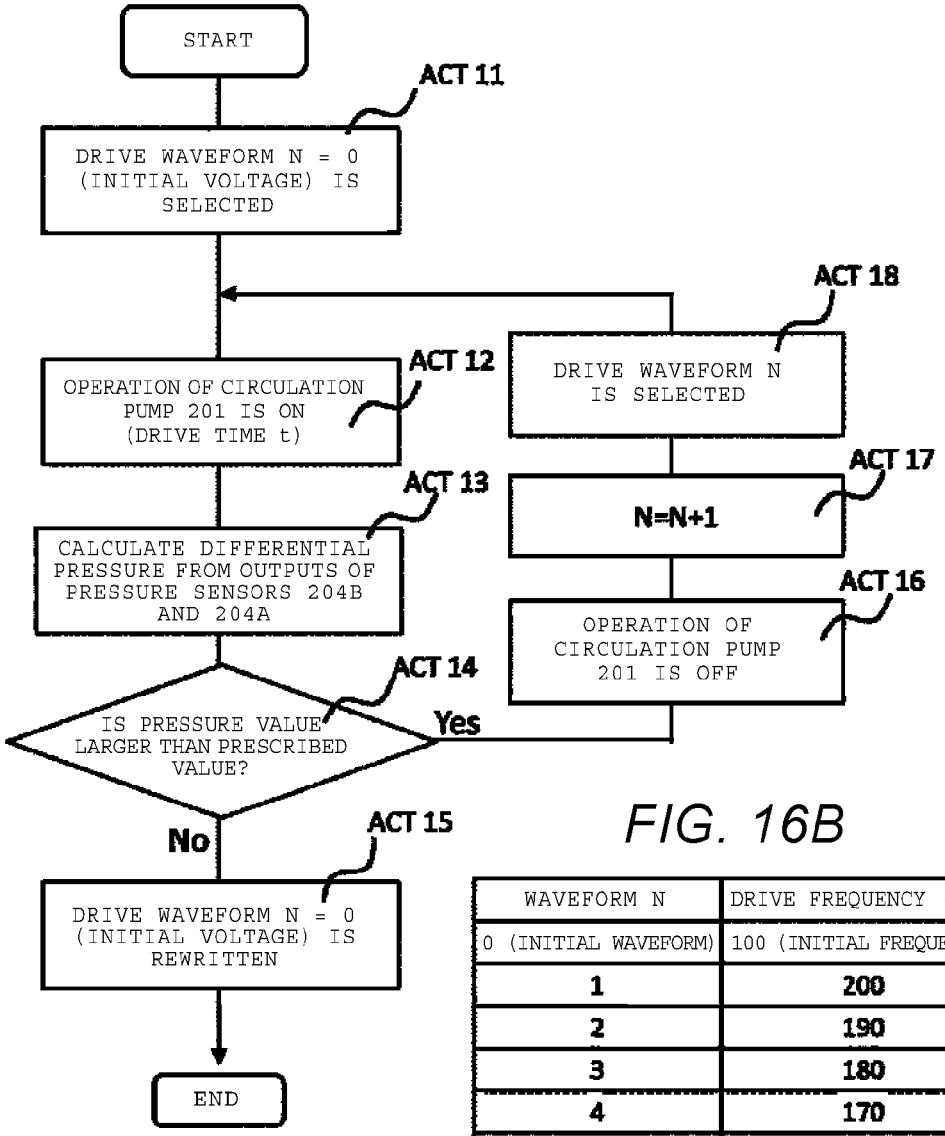
FIG. 16A is a control flowchart according to the second embodiment.
FIG. 16B is a table showing a waveform number and a value of a drive frequency.

FIG. 16A is a flowchart illustrating a process of changing the drive frequency of the ink circulation pump 201. FIG. 16B is a table showing a waveform number (N) and a value of the drive frequency (Hz). The differential pressure between the ink chamber 428 and the supply-side ink tank 210 is detected, and the drive frequency of the ink circulation pump 201 is controlled such that the differential pressure is equal to or lower than the specified value (e.g., bubble point pressure). The drive frequency of the ink circulation pump 201 is changed in the middle of the waiting state, similarly to the description according to the first embodiment.

In a case where a change of the drive frequency starts, the ink circulation pump 201 is operated at an initial value (N=0) drive frequency 100 Hz of the drive waveform (ACT 11). The voltage is 200 Vp-p. The ink circulation pump 201 is operated at the initial value drive frequency in t time (ACT 12). A difference between pressures (differential pressure), which are detected by the pressure sensors 204B and 204A, is calculated (ACT 13). The differential pressure is compared with the specified value (ACT 14). In a case where the differential pressure is larger than the specified value (YES), the circulation pump 201 stops (ACT 16), and the waveform number is changed (N=N+1) (ACT 17). The frequency of the drive waveform N is changed (ACT 18), and processes in (ACT 12) to (ACT 14) are repeated until the differential pressure is equal to or lower than the specified value. The drive frequency N, in which the differential pressure is equal to or lower than the specified value, is set to a new initial value. Thereafter, the ink circulation pump 201 is operated at the drive frequency in which the differential pressure is equal to or lower than the specified value. Subsequently, the ink circulation pump 201 is operated at the new initial value until an instruction to change the drive frequency of the ink circulation pump 201 is generated.

The second embodiment provides the same advantage as in the first embodiment other than the drive circuit.

In the embodiment, an example is described in which the ink circulation device is integrally formed with the ink jet head. It is possible to form the ink circulation device and the ink jet head separately. In addition, it is possible to form, for example, the control circuit and configurations other than the control circuit separately in the ink circulation device. The drive voltage of the piezoelectric pump is changed in the first embodiment, and the drive frequency of the piezoelectric pump is changed in the second embodiment. It is possible to combine and change the drive voltage and the drive frequency in accordance with the ink, and to drive the piezoelectric pump.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink circulation device for an ink jet head comprising:

a first ink storage unit that stores ink to be supplied to an ink jet head;

a second ink storage unit that stores ink to be returned from the ink jet head;

a pump that operates according to an electric signal to transport the ink from the second ink storage unit to the first ink storage unit;

a filter between the pump and the first ink storage unit;

a first pressure sensor configured to detect an internal pressure of the first ink storage unit;

a second pressure sensor configured to detect an internal pressure of an ink chamber between the pump and the filter; and a drive circuit configured to generate the electric signal according to a pressure difference between the internal pressure detected by the second pressure sensor and the internal pressure detected by the first pressure sensor.

2. The ink circulation device for an ink jet head according to claim wherein the drive circuit is configured to lower a voltage of the electric signal such that the pressure difference is equal to or lower than a preset pressure difference.

3. The ink circulation device for an ink jet head according to claim 2, wherein the preset pressure difference is different for different inks.

4. The ink circulation device for an ink jet head according to claim 1, wherein the drive circuit is configured to lower a drive frequency of the electric signal such that the pressure difference is equal to or lower than a preset pressure difference.

5. The ink circulation device for an ink jet head according to claim 4, wherein the preset pressure difference is different for different inks.

6. The ink circulation device for an ink jet head according to claim 1, further comprising:

a second pump configured to operate to supply ink to the first ink storage unit through the filter.

7. The ink circulation device for an ink jet head according to claim 1, wherein the first pressure sensor is provided in a location which is higher than an ink liquid surface in the first ink storage unit in a gravity direction, and wherein the second pressure sensor is provided in a location which is higher than the pump in the gravity direction.

8. An ink jet head assembly comprising:

a housing;

an ink jet head mounted to a lower part of the housing; and an ink circulation device for supplying ink to the ink jet head, the ink circulation device including a first ink storage unit that stores ink to be supplied to the ink jet head;

a second ink storage unit that stores ink to be returned from the ink jet head;

a pump that operates according to an electric signal to transport the ink from the second ink storage unit to the first ink storage unit;

a filter between the pump and the first ink storage unit;

a first pressure sensor configured to detect an internal pressure of the first ink storage unit;

a second pressure sensor configured to detect an internal pressure of an ink chamber between the pump and the filter; and a drive circuit configured to generate the electric signal according to a pressure difference between the internal pressure detected by the second pressure sensor and the internal pressure detected by the first pressure sensor.

9. The ink jet head assembly according to claim 8, wherein the drive circuit is configured to lower a voltage of the electric signal such that the pressure difference is equal to or lower than a preset pressure difference.

10. The ink jet head assembly according to claim 9, wherein the preset pressure difference is different for different inks.

11. The ink jet head assembly according to claim 8, wherein the drive circuit is configured to lower a drive frequency of the electric signal such that the pressure difference is equal to or lower than a preset pressure difference.

12. The ink jet head assembly according to claim 11, wherein the preset pressure difference is different for different inks.

13. The ink jet head assembly according to claim 8, wherein the ink circulation device further includes:

a second pump configured to operate to supply ink to the first ink storage unit through the filter.

14. The ink jet head assembly according to claim 8, wherein the first pressure sensor is provided in a location which is higher than an ink liquid surface in the first ink storage unit in a gravity direction, and wherein the second pressure sensor is provided in a location which is higher than the pump in the gravity direction.

15. A method of circulating ink through an ink circulation device for an ink jet head, said method comprising:

storing ink to be supplied to an ink jet head in a first ink storage unit;

storing ink to be returned from the ink jet head in a second ink storage unit;

operating a pump according to an electric signal to transport the ink from the second ink storage unit to the first ink storage unit;

filtering the ink between the pump and the first ink storage unit with a filter;

measuring an internal pressure of the first ink storage unit and an internal pressure of an ink chamber between the pump and the filter; and generating the electric signal to operate the pump and to transport the ink from the second ink storage unit to the first ink storage unit, according to a pressure difference between the internal pressure between the pump and the filter and the internal pressure of the first ink storage unit.

16. The method according to claim 15, further comprising:

lowering a voltage of the electric signal such that the pressure difference is equal to or lower than a preset pressure difference.

17. The method according to claim 16, wherein the preset pressure difference is different for different inks.

18. The method according to claim 15, further comprising:

lowering a drive frequency of the electric signal such that the pressure difference is equal to or lower than a preset pressure difference.

19. The method according to claim 18, wherein the preset pressure difference is different for different inks.

20. The method according to claim 15, further comprising:

operating a second pump to supply ink to the first ink storage unit through the filter.

* * * * *